US009138700B2

(12) United States Patent
Van Dam et al.

(10) Patent No.: US 9,138,700 B2
(45) Date of Patent: Sep. 22, 2015

(54) ACCURATE AND RAPID MICROMIXER FOR INTEGRATED MICROFLUIDIC DEVICES

(75) Inventors: R. Michael Van Dam, Los Angeles, CA (US); Kan Liu, Culver City, CA (US); Kwang-Fu Clifton Shen, West Lake Village, CA (US); Hsian-Rong Tseng, Los Angeles, CA (US)

(73) Assignee: The Regents of the University of California, Oakland, CA (US)

( * ) Notice: Subject to any disclaimer, the term of this patent is extended or adjusted under 35 U.S.C. 154(b) by 1384 days.

(21) Appl. No.: 12/863,276

(22) PCT Filed: Jan. 21, 2009

(86) PCT No.: PCT/US2009/031582

§ 371 (c)(1),
(2), (4) Date: Jan. 18, 2011

(87) PCT Pub. No.: WO2009/092106

PCT Pub. Date: Jul. 23, 2009

(65) Prior Publication Data

US 2011/0103176 A1 May 5, 2011

Related U.S. Application Data

(60) Provisional application No. 61/006,551, filed on Jan. 18, 2008.

(51) Int. Cl.
*B01F 13/00* (2006.01)
*B01F 15/04* (2006.01)

(52) U.S. Cl.
CPC ..... *B01F 13/0071* (2013.01); *B01F 15/0462* (2013.01); *Y10T 137/8593* (2015.04)

(58) Field of Classification Search
CPC ..... B01F 13/0071
USPC ..... 366/179.1, 181.8, 182.4
See application file for complete search history.

(56) References Cited

U.S. PATENT DOCUMENTS

| | | | | |
|---|---|---|---|---|
| 6,168,948 | B1 * | 1/2001 | Anderson et al. | 435/287.2 |
| 6,326,211 | B1 | 12/2001 | Anderson et al. | |
| 6,767,194 | B2 | 7/2004 | Jeon et al. | |
| 6,916,113 | B2 | 7/2005 | Van de Goor et al. | |
| 7,040,338 | B2 | 5/2006 | Unger et al. | |

(Continued)

OTHER PUBLICATIONS

Wu et al., "Rapid Mixing Using Two-Phase Hydraulic Focusing in Microchannels", Biomedical Microdevices, 2005, pp. 13-20, 7:1.

(Continued)

*Primary Examiner* — David Sorkin
*Assistant Examiner* — Abbas Rashid
(74) *Attorney, Agent, or Firm* — Venable LLP; Henry J. Daley; Laura G. Remus

(57) ABSTRACT

The invention may provide a microfluidic mixer having a droplet generator and a droplet mixer in selective fluid connection with the droplet generator. The droplet generator comprises first and second fluid chambers that are structured to be filled with respective first and second fluids that can each be held in isolation for a selectable period of time. The first and second fluid chambers are further structured to be reconfigured into a single combined chamber to allow the first and second fluids in the first and second fluid chambers to come into fluid contact with each other in the combined chamber for a selectable period of time prior to being brought into the droplet mixer.

12 Claims, 22 Drawing Sheets

(56) References Cited

U.S. PATENT DOCUMENTS

| | | | | |
|---|---|---|---|---|
| 7,114,699 | B2 | 10/2006 | Hull et al. | |
| 7,150,999 | B1 | 12/2006 | Shuck | |
| 7,862,000 | B2 | 1/2011 | Elizarov et al. | |
| 8,206,593 | B2 * | 6/2012 | Lee et al. | 210/640 |
| 8,480,053 | B2 * | 7/2013 | Heath et al. | 251/7 |
| 2005/0255000 | A1 * | 11/2005 | Yamamoto et al. | 422/68.1 |
| 2006/0280029 | A1 | 12/2006 | Garstecki et al. | |
| 2007/0012891 | A1 | 1/2007 | Maltezos et al. | |
| 2007/0051412 | A1 | 3/2007 | Heath et al. | |
| 2007/0200081 | A1 * | 8/2007 | Elizarov et al. | 251/331 |
| 2008/0131327 | A1 | 6/2008 | Van Dam et al. | |
| 2011/0136252 | A1 * | 6/2011 | Tseng et al. | 436/180 |

OTHER PUBLICATIONS

Hessel et al., "Micromixers—a review on passive and active mixing principles", Chemical Engineering Science, 2005, pp. 2479-2501, 60.

Gunther et al., Micromixing of Miscible Liquids in Segmented Gas-Liquid Flow, Langmuir, 2005, pp. 1547-1555, 21.

Song et al. "Reactions in Droplets in Microfluidic Channels", Angew Chem Int Ed Engl., 2006, pp. 7336-7356. ( 45)44.

Song et al., "Experimental test of scaling of mixing by chaotic advection in droplets moving through microfluidic channels", Applied Physics Letters, 2003, pp. 4664-4666, 83(12).

Song et al., "Millisecond Kinetics on a Microfluidic Chip Using Nanoliters of Reagents", J. Am. Chem. Soc. 2003, pp. 14613-14619, 125(47).

Tice et al. "Effects of viscosity on droplet formation and mixing in microfluidic channels", Analytica Chimica Acta, 2004, pp. 73-77, 507.

Chou et al.,"A Microfabricated Rotary Pump", Biomedical Microdevices, 2001, pp. 323-330, 3:4.

Hansen et al., "Systematic investigation of protein phase behavior with a microfluidic formulator", PNAS, 2004, pp. 14431-14436, 101,40.

Squires et al., Microfluidics: Fluid physics on the nanoliter scale, Reviews of Modem Physics, 2005, pp. 977-1026, 77.

Srisa-Art et al., "High-Throughput DNA Droplet Aassays Using Picoliter Reactor Volumes", Anal. Chem., Aug. 4, 2007 , pp. 6682-6689.

International Search Report and Written Opinion for PCT/US2009/031582.

* cited by examiner

ACCURATE AND RAPID MICROMIXER FOR INTEGRATED MICROFLUIDIC DEVICES

CROSS-REFERENCE OF RELATED APPLICATION

This application claims priority to U.S. Provisional Application No. 61/006,551 filed Jan. 18, 2008, the entire contents of which are hereby incorporated by reference, and is a U.S. national stage application under 35 U.S.C. §371 of PCT/US2009/031582 filed Jan. 21, 2009, the entire contents of which are incorporated herein by reference.

The invention was made with Government support of Grant No. DE-FG-06ER64249 awarded by the Department of Energy and Grant No. CA119347 awarded by the National Institutes of Health. The United States Government has certain rights in the invention.

BACKGROUND

1. Field of Invention

The current invention relates to microfluidic devices, and more particularly to microfluidic devices that include a droplet generator.

2. Discussion of Related Art

Thorough mixing is paramount for performing chemical or biochemical reactions to achieve high and repeatable yields. Rapid mixing improves desired reactions by avoiding side reactions caused by, for example, large excess of one reagent in uneven distribution. Speed of mixing may be particularly important in certain applications such as, for example, certain fast organic/inorganic syntheses or radiolabeling of imaging probes for positron emission tomography (PET) because of the short half-life time of the radioisotopes used.

Microfluidic chips typically manipulate fluid volumes in the range of nL (nanoliters) to μL (microliters). Mixing in these chips is challenging due to the absence of turbulence under most normal operating conditions due to low Reynold's number. As is well known in the art, the mixing rate is generally limited by diffusion. For example, if two streams enter a single channel at a Y-junction, the streams will flow side-by-side and, depending on flow rates and diffusion constants, a relatively long flow distance is needed before the streams are well-mixed by diffusion.

A vast range of mixing methods and chip designs have been reported in the literature (Nguyen, N-T, Wu, Z., Micromixers—a review, J. Micromech. Microeng. 15: R1-R16 2005; Hessel, V., Lowe, H., Schonfeld, F., Micromixers—a review on passive and active mixing principles, Chemical Engineering Science 60: 2479-2501, 2005). Passive and active means to "stretch and fold" the fluids to be mixed have been reported in which the diffusion distance is decreased and mixing by diffusion may occur more rapidly (Gunther, A., Jhunjhunwala, M., Thalmann, M., Schmidt, M. A., Jensen, K. F., Micromixing of miscible liquids in segmented gas-liquid flow, Langmuir 21(4): 1547-1555, 2005).

Droplet-based mixing may be the most efficient as measured in terms of time and on-chip space, in contrast to other forms of mixing that take much more time and on-chip space. One method of droplet-based mixing employs a continuous flow droplet-based approach (Gunther, A., Jhunjhunwala, M., Thalmann, M., Schmidt, M. A., Jensen, K. F., Micromixing of miscible liquids in segmented gas-liquid flow, Langmuir 21(4): 1547-1555 2005; Song, H., Chen, D. L., Ismagilov, R. F., Reactions in proplets in Microfluidic Channels, Angewandte Chemie 45: 7336-7356, 2006; Song, H., Bringer, M. R., Tice, J. D. Gerdts, C. J., Ismagilov, R. F., Experimental test of scaling of mixing by chaotic advection in droplets moving through microfluidic channels, Applied Physics Letters 83(22): 4664-4666, 2003; Song, H., Ismagilov, R. F., Millisecond kinetics on a microfluidic chip using nanoliters of reagents, J. Am. Chem. Soc. 125: 14613-14619, 2003). Droplets containing two or more reagents with desired ratios of volume are created by physical processes and flow along a microchannel. The flow process generates a chaotic mixing action within a droplet that may improve mixing length and time. For example, the Ismagilov group has observed sub-second mixing time in a dispersionless droplet mixing technology that they developed (Ismagilov, R. F., Experimental test of scaling of mixing by chaotic advection in droplets moving through microfluidic channels, Applied Physics Letters 83(22): 4664-4666, 2003; Song, H., Ismagilov, R. F., Millisecond kinetics on a microfluidic chip using nanoliters of reagents, J. Am. Chem. Soc. 125: 14613-14619, 2003). They found that the spatial distribution of liquids within a droplet is critical to the mixing efficiency in straight mixing channels. Specifically, a droplet that has end-to-end distribution mixes more efficiently than a droplet having a side-by-side distribution. The reason is that liquid flowing in a straight channel creates a recirculation within each half, side-by-side, in the droplet. A serpentine flow path may be needed for more efficient mixing of a droplet having a side-by-side distribution.

Although fast mixing may be achieved, the implementation is difficult for a number of applications, especially those using low volumes of at least one reagent. This is because it is hard to make the reagents that are being mixed arrive at the mixing junction exactly at the same time. Quite often, some droplets have to be discarded due to, for example, incorrect volume ratios. Incorrect ratios also can occur as droplet formation stabilizes in the first several minutes of operation, requiring the incorrectly formed droplets to be discarded. Furthermore, flow rates and other parameters must be laboriously tuned with care since operation depends on, for example, temperature, viscosity, type of solvents, number of reagents, desired volume ratios, etc. For example, Tice et al (Tice, J. D., Lyon, A. D., Ismagilov, R. F., Effects of viscosity on droplet formation and mixing in microfluidic channels, Analytica Chimica Acta 507: 73-77, 2004) observed viscosity to have an enormous impact on initial spatial distribution of reagents within each droplet, ranging from optimally good to the opposite for mixing in a straight channel. Variations in conditions over time can affect droplet uniformity. Generation of series of droplets having different sizes, volume ratios, etc. is especially difficult and many droplets must be discarded in the transition interval as operating parameters are altered.

In addition to the passive mixers that have been demonstrated in continuous flow microfluidic devices, active mixing has been demonstrated in integrated microfluidic chips. For example, the rotary mixer developed by Quake et al. (Chou, H-P, Unger, M. A., Quake, S. R. A microfabricated rotary pump, Biomedical Microdevices 3(4): 323-330, 2001; Hansen, C. L., Sommer, M. O. A., Quake, S. R., Systematic investigation of protein phase behavior with a microfluidic formulator, PNAS 101(40): 14431-14436, 2004) may be the most commonly used approach and has a simple fabrication process. The mixer, for example, may have one continuous closed path (e.g., a ring) around which fluids can be pumped. Due to extreme Taylor dispersion, the fluids become mixed after several cycles around the ring (Squires, T. M., Quake, S. R. Microfluidics: fluid physics on the nanoliter scale, Reviews of Modern Physics 77: 977-1026, 2005). The use of microvalves, in constrast to continuous flow microfluidic devices, can facilitate the manipulation of very small fluid volumes.

The rotary mixer and its variations, however, are not scalable designs. As the volume/length of the mixer increases, a longer time is required for circulating the fluids, and the effectiveness of pumping diminishes. For modest volumes (e.g., 1 μL), it can take several minutes to achieve thorough mixing. Furthermore, the rotary mixer and its variations are sensitive to the presence of bubbles, which may occur in a reaction resulting in the fluids being heated above the boiling point or the release of gas.

Therefore, there is a need for devices and methods for rapid and accurate mixing for integrated microfluidic devices.

SUMMARY

Some embodiments of the current invention provide a microfluidic mixer having a droplet generator and a droplet mixer in selective fluid connection with the droplet generator. The droplet generator comprises first and second fluid chambers that are structured to be filled with respective first and second fluids that can each be held in isolation for a selectable period of time. The first and second fluid chambers are further structured to be reconfigured into a single combined chamber to allow the first and second fluids in the first and second fluid chambers to come into fluid contact with each other in the combined chamber for a selectable period of time prior to being brought into the droplet mixer.

Some embodiments of the current invention provide a microfluidic droplet generator that has first and second fluid chambers structured to be filled with respective first and second fluids that can each be held in isolation for a selectable period of time. The first and second fluid chambers are further structured to be reconfigured into a single combined chamber to allow the first and second fluids in the first and second fluid chambers to come into fluid contact with each other in the combined chamber for a selectable period of time prior to said droplet generator being brought into fluid connection with a microfluidic device.

Some embodiments of the current invention may provide a method of mixing fluids that includes: filling a first microfluidic chamber with a first fluid and holding it in isolation for a first selectable period of time; filling a second microfluidic chamber with a second fluid and holding it in isolation for a second selectable period of time; providing a fluid connection between the first and second microfluidic chambers after the first and second selectable periods of time to allow the first and second fluids to come into fluid contact to form a droplet while said droplet remains otherwise in isolation for a third selectable period of time, and providing a fluid connection between the first and second microfluidic chambers and a droplet mixer to allow the droplet to flow into said droplet mixer.

BRIEF DESCRIPTION OF THE DRAWINGS

Further objectives and advantages will become apparent from a consideration of the description, drawings, and examples.

DETAILED DESCRIPTION

Some embodiments of the current invention are discussed in detail below. In describing embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the current invention. All references cited herein are incorporated by reference as if each had been individually incorporated.

Herein the terms "microfluidic chip", "microfluidic chip system", "chip", "microfluidic device" may be used interchangeably without significantly changing the context of the disclosure. Specifically, the "microfluidic chip system" refers to the microfluidic chip and other components going into and out of the chip, whereas "chip" and "microfluidic chip" both refer to the microfluidic chip alone. A "microfluidic device" refers to a device or component having microfluidic properties.

Figure 1A:
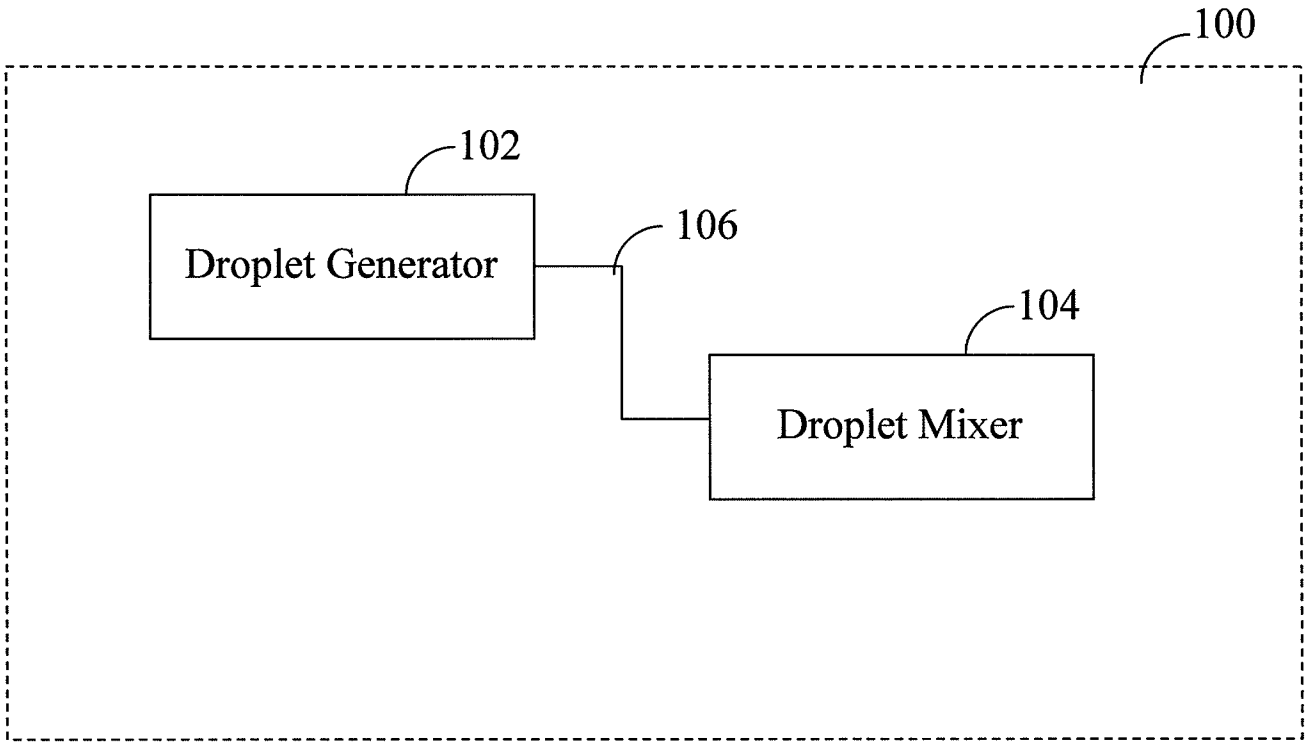
FIG. 1A shows a diagrammatic illustration of a micromixer according to an embodiment of the current invention.

FIG. 1A shows a diagrammatic illustration of a micromixer 100 according to an embodiment of the current invention. Micromixer 100 includes a droplet generator 102 and a droplet mixer 104. Droplet generator 102 may have chamber structures to generate, for example, one or more droplets. Droplet mixer 104 may have channel structures to mix, for example, the generated droplets. Droplet generator 102 is in fluid connection with droplet mixer, e.g., via structure 106. Structure 106 may be a channel through which droplets can be transported.

Figure 1B:
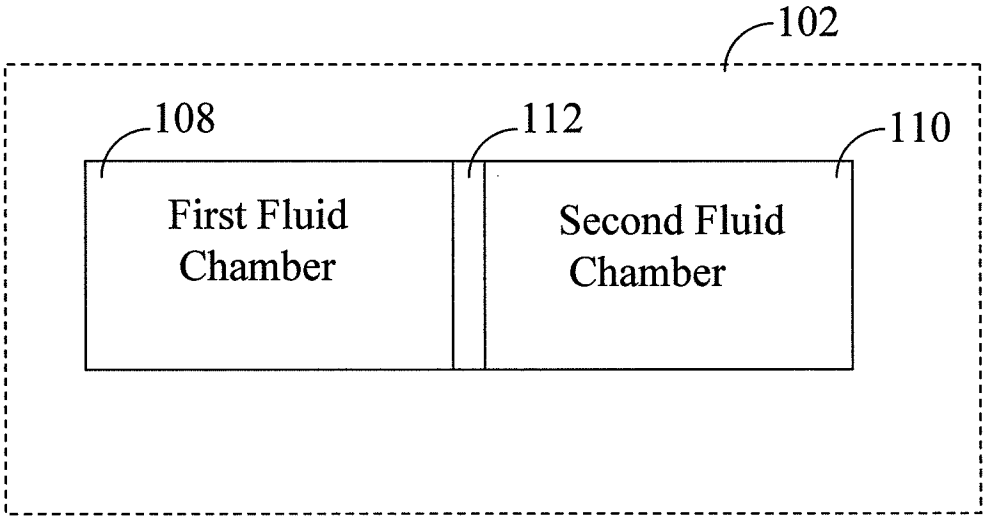
FIG. 1B shows a diagrammatic illustration of a droplet generator according to an embodiment of the current invention.

FIG. 1B shows a diagrammatic illustration of a droplet generator 102 according to an embodiment of the current invention. Droplet generator 102 may include a first chamber 108 and a second chamber 110. Structure 112 may separate first chamber 108 and second chamber 110. Structure 112 may be lifted or otherwise moved to allow chambers 108 and 110 to become a single combined chamber. Structure 112 may be, for example, a valve.

Figure 2:
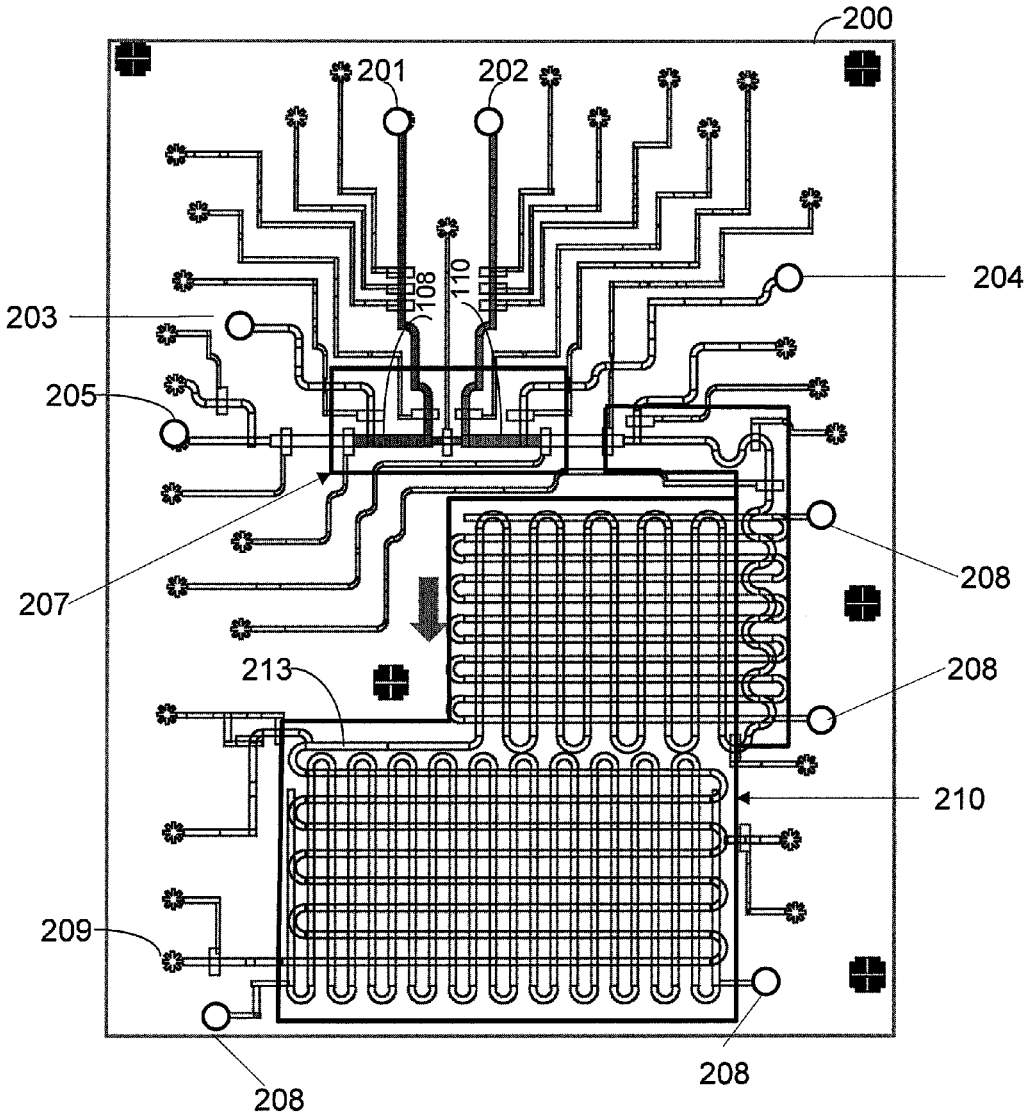
FIG. 2 shows a schematic illustration of a micromixer chip according to an embodiment of the current invention.

FIG. 2 shows a schematic illustration of a micromixer chip 200 according to an embodiment of the current invention. Droplet generator 207 may include fluid chambers 108 and 110. Inlets 201 and 202 may feed fluid chambers 108 and 110, respectively. Vacuum ports 203 and 204 may serve fluid chambers 108 and 110, respectively. Droplet mixer 104 may include serpentine channel 213. Degasser 210 may be served by vacuum port 208. Outlet 209 may be an exit for droplets produced by micromixer chip 200. Outlet 209 may further interface to other microfluidic devices.

Reagent A may enter fluid chamber 108 via inlet 201 and reagent B may enter fluid chamber 110 via inlet 202. Fluid chambers 108 and 110 may be configured to become one combined chamber after being filled with reagents A and B for certain periods of time. The droplet generated by the combined chamber may be pushed to serpentine channel 213 via, for example, coordinated applications of high-pressure air through gas inlet 205. In degasser 210, vacuum may be applied through vacuum port 208 to remove gas within and between generated droplets. For example, due to a pressure drop across a thin membrane between serpentine channel 213 and the channels connected to vacuum port 208 of degasses 210, gas may pass through the thin membrane into the channels connected to vacuum port 208. After flowing through serpentine channel 213, generated droplets of desired mixing ratio(s) may exit via outlet 209.

The design of droplet generator 102 may allow great flexibility and may enable us to achieve mixing in a distance shorter than that of conventional droplet mixers reported in the literature. The shorter distance associated with mixing may allow us to further reduce the mixing time and to reduce on-chip space used.

In addition, a narrow channel may be placed between fluid chambers 108 and 110, such that a "jet" from fluid chamber 108 flows into fluid chamber 110 and pre-mixes the droplet so a portion of the circulating flow is substantially complete before the droplet has had a chance to move very far. The "jet" effect can also be created by air bubbles between the two fluid chambers. We have observed an air bubble to suddenly shift to one side of the microchannel leaving a narrow jet of liquid to flow between the channel wall and the bubble. This bubble actually serves a temporary induction role in the "jet" formation.

Very large droplets may also be made according to some embodiments of the current invention. We have observed in our experiments large droplets that were mixed very well, and this can increase the throughput (e.g., volume mixed per time) of the mixer. Large droplets (e.g., hundreds of nanoliters in volume) are difficult to make stably in a continuous flow chip, and the controllable range of droplet sizes is quite limited. For example, only about one order of magnitude difference in size could be achieved in the literature (Song, H., Ismagilov, R. F., Millisecond kinetics on a microfluidic chip using nanoliters of reagents, J. Am. Chem. Soc. 125: 14613-14619, 2003).

The examples use air which may be removed between the sequence of droplets after mixing by pulling vacuum through a thin membrane between two channels of the chip. One could use other methods of removing gas from the channels, including liquid/gas separators according to other embodiments of the current invention. For example, these separators may include fine channels/porous membrane through which liquid passes but not gas in some embodiments of the current invention.

For the conservation of on-chip space, degasser 210 may begin functioning while the droplets are still being mixed. Care should be taken such that the generated droplets remain separated until each droplet is fully mixed, or mixing may not be completed.

In general, the micromixer chip 200 may be made of such materials as silicon, glass, polymer, epoxy-polymer, polydimethylsiloxane (PDMS), perfluoropolyether (PFPE) etc. In some embodiments, variation in at least one dimension of microfabricated structures is controlled to the micron level, with at least one dimension being microscopic (i.e. below 1000 μm). Microfabrication can involve semiconductor or microelectrical-mechanical systems (MEMS) fabrication techniques such as photolithography and spin coating that are designed to produce feature dimensions on the microscopic level, with at least some of the dimensions of the microfabricated structure requiring a microscope to reasonably resolve/image the structure. Examples of fabrication of microfluidic chips in the art include, U.S. Pat. No. 7,040,338, and U.S. patent application Ser. Nos. 11/297,651; 11/514,396, and 11/701,917. Materials and methods disclosed in these references are applicable for the fabrication of some embodiments of the current invention.

Some embodiments of the current invention may provide a way to inexpensively and accurately generate droplets of different mixing ratios by filling fixed volume reservoirs on the chip. No specialized hardware is required, such as expensive syringe pumps or other types of complex on-chip or off-chip metering pumps.

FIG. 3A-3I illustrate a process of generating droplets according to an embodiment of the current invention.

Figure 3A:
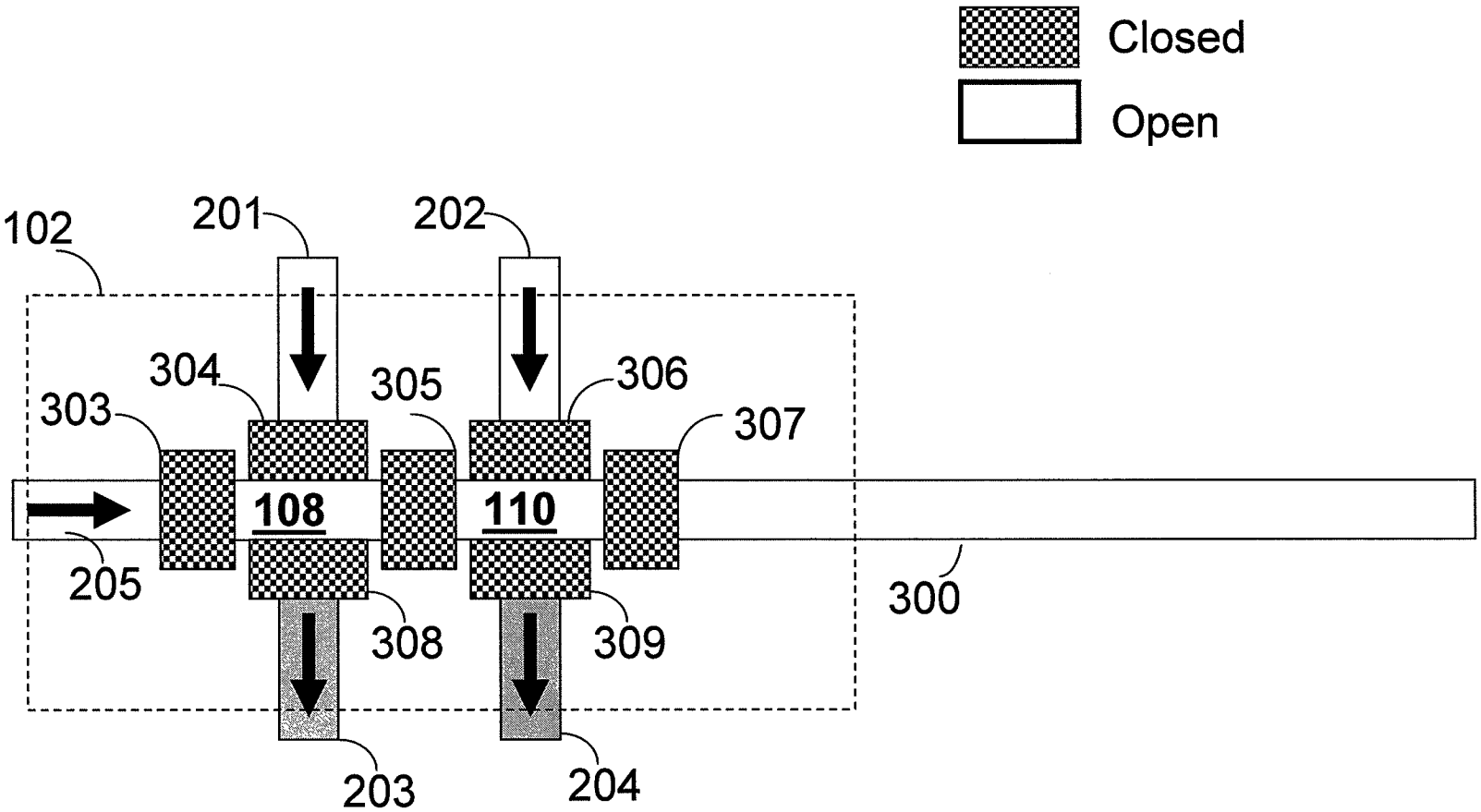
FIGS. 3A-3I illustrate an example of generating droplets according to an embodiment of the current invention.

FIG. 3A shows a schematic view of a droplet generator that can correspond to droplet generator 102 according to an embodiment of the current invention. The droplet generator 102 has two fluid chambers located along microchannel 300. A first fluid chamber 108 is surrounded by valves 303, 304, 305, and 308. Inlet 201 is a port through which a reagent may be loaded into first fluid chamber 108. Gas inlet 205 is a port through which gas may be allowed to enter microchannel 300. Vacuum port 203 may connect to a vacuum pump. A second fluid chamber 110 is surrounded by valves 305, 306, 307, and 309. Valve 305 may connect the first fluid chamber 108 with the second fluid chamber 110. Inlet 202 is a port through which a reagent may be loaded into the second fluid chamber 110. Vacuum port 204 is a port that may connect to a vacuum pump.

Figure 3B:
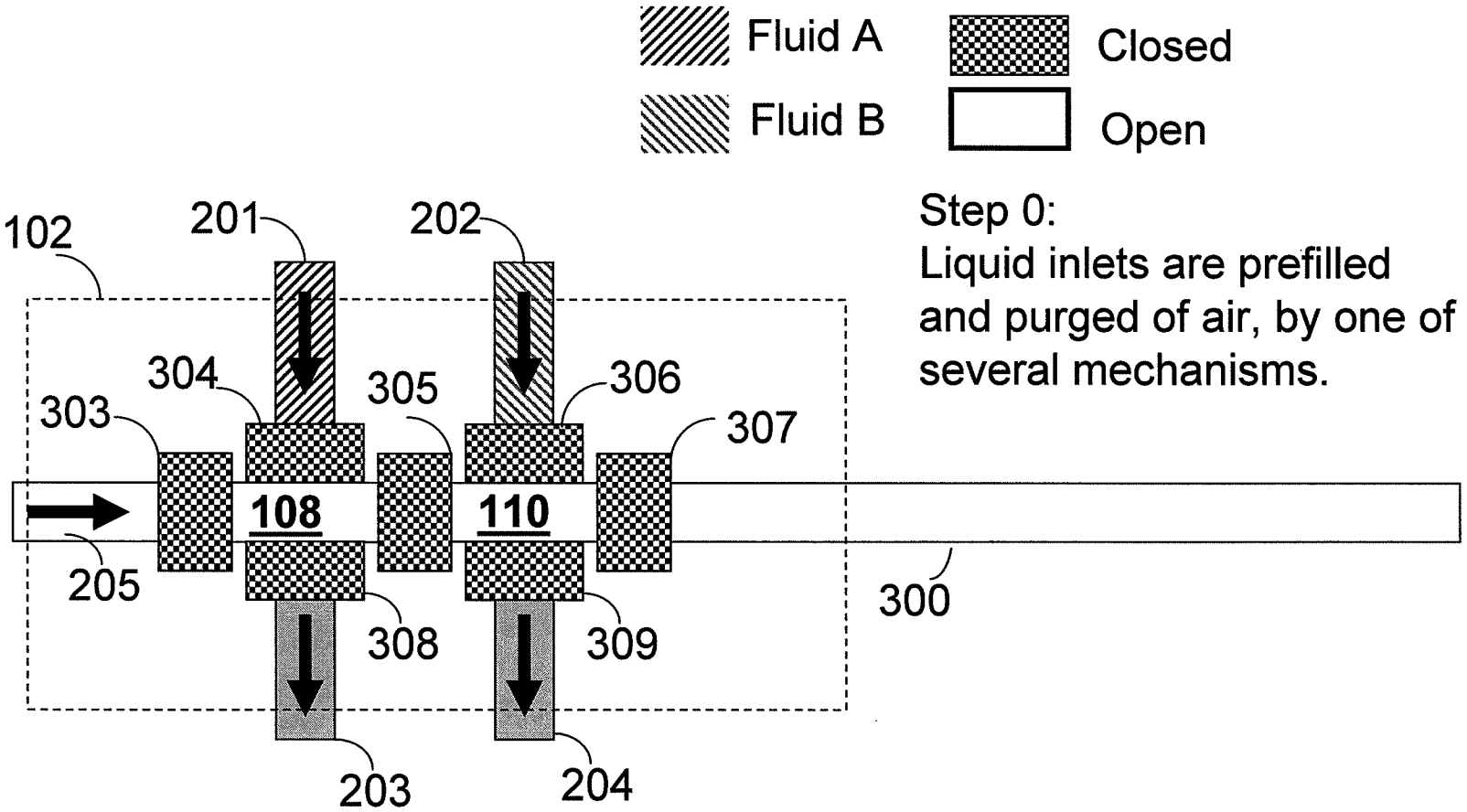

FIG. 3B shows an example of one step during operation of the droplet generator 102. Inlet 201 is prefilled with reagent A and inlet 202 is prefilled with reagent B. To start the mixer, it is noted that the input reagents must be connected to micromixer chip 200. Further, it is noted that the principle of dead-end-filling may be used to ensure the reagents displace substantially all air in inlets 201 and 202 such that reagent A and reagent B are touching one side of valve 304 and 306, respectively.

Figure 3C:
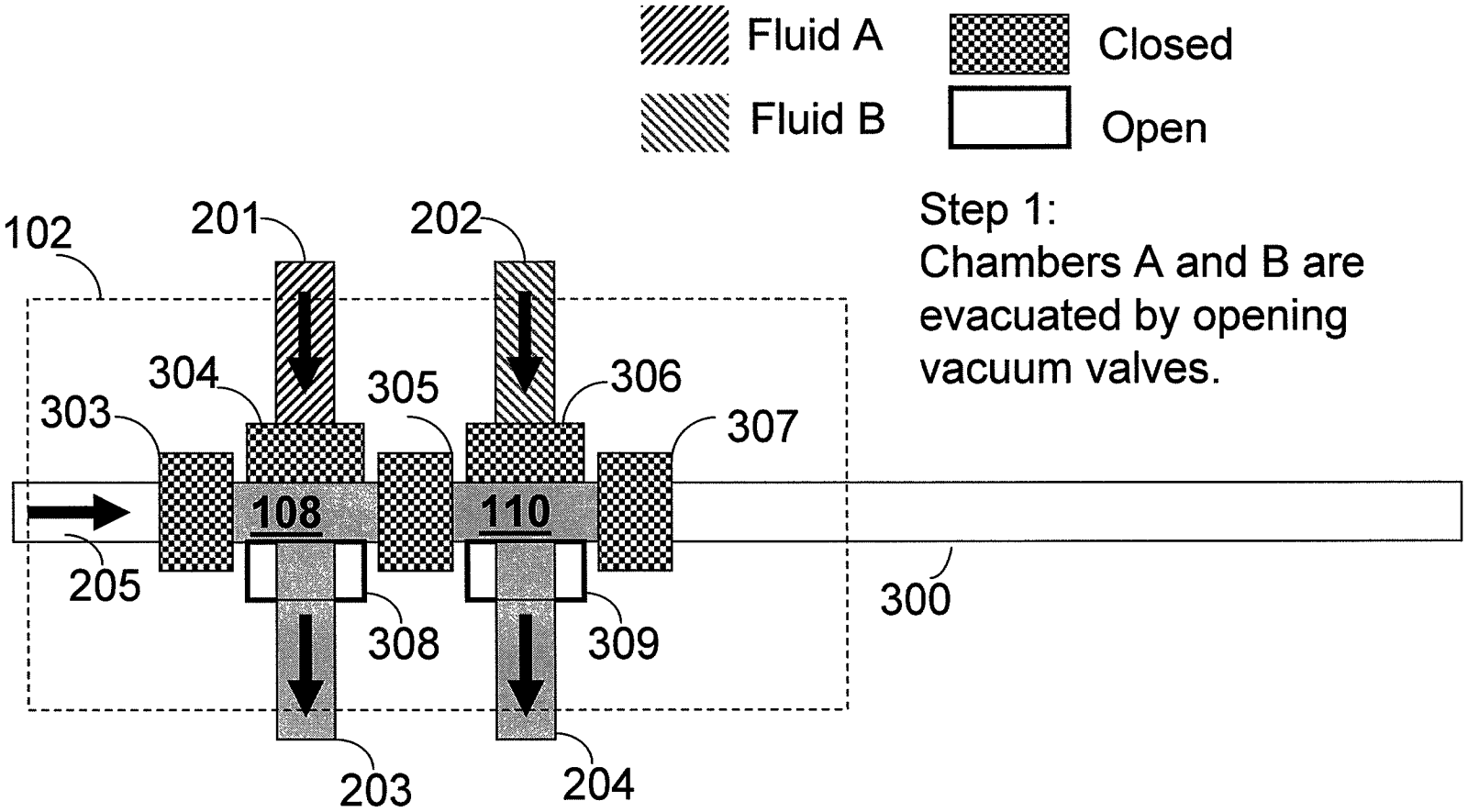

FIG. 3C shows an example of a subsequent step during operation of the droplet generator 102. Valves 308 and 309 may be opened and a vacuum may be applied through vacuum ports 203 and 204 to the droplet generator 102 to remove substantially all air in the fluid chambers 108 and 110.

Figure 3D:
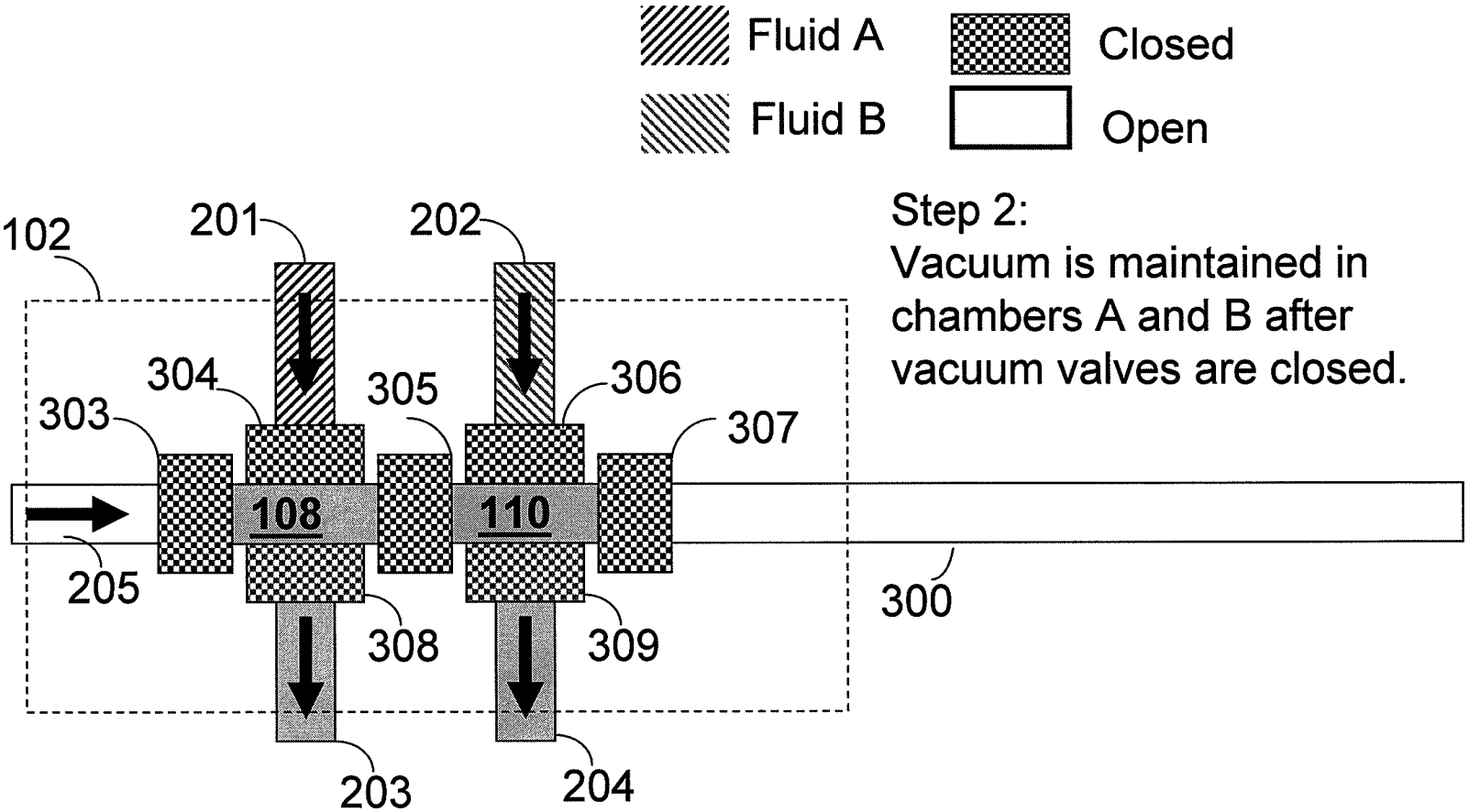

FIG. 3D shows an example of a subsequent step during operation of the droplet generator 102. Valves 308 and 309 may be closed to maintain the vacuum inside the fluid chambers 108 and 110.

Figure 3E:
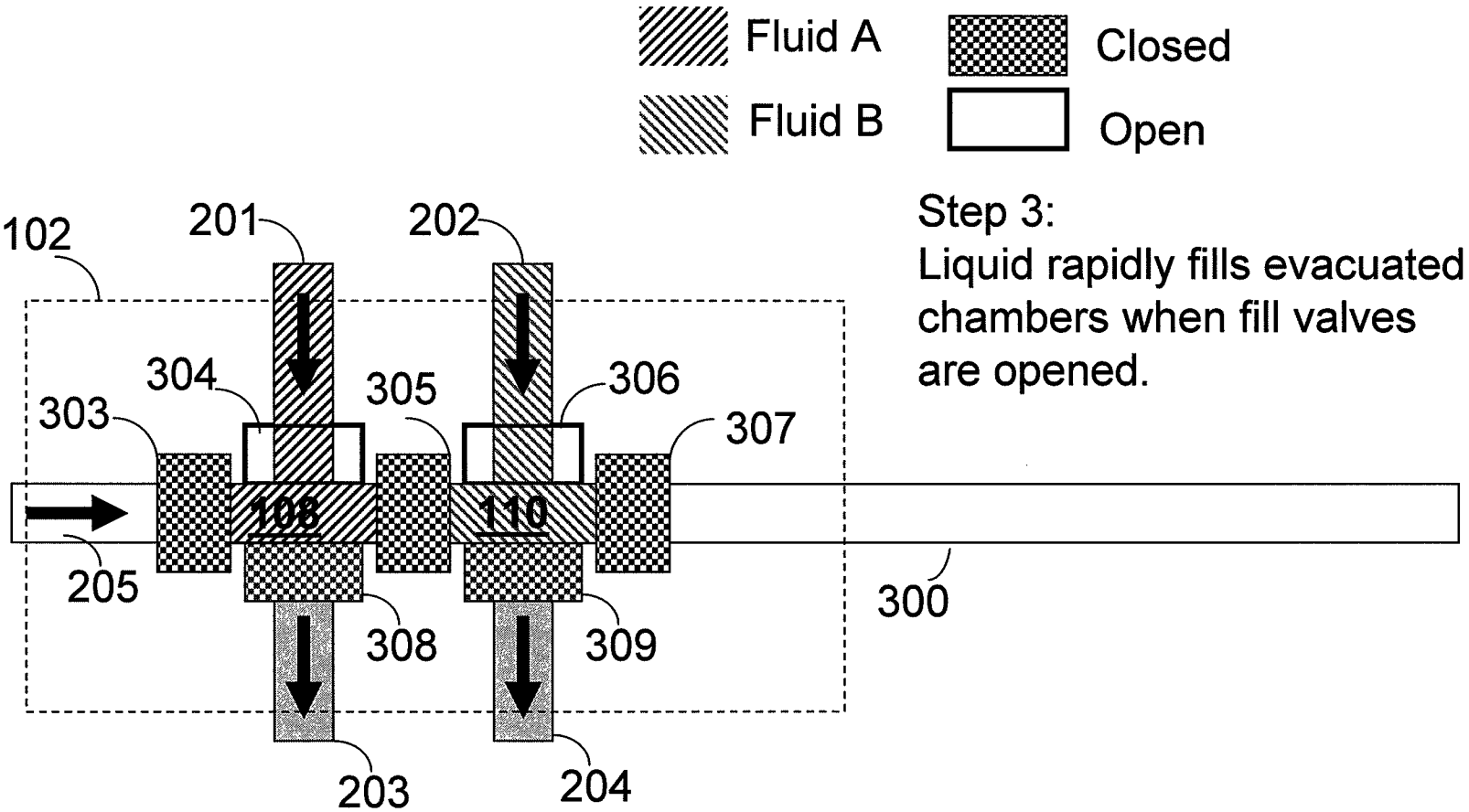

FIG. 3E shows an example of a subsequent step during operation of the droplet generator 102. Valves 304 and 306 are opened and reagents A and B rush in (assisted by the negative pressure provided by the vacuum) to their respective fluid chambers 108 and 110 until full.

Figure 3F:
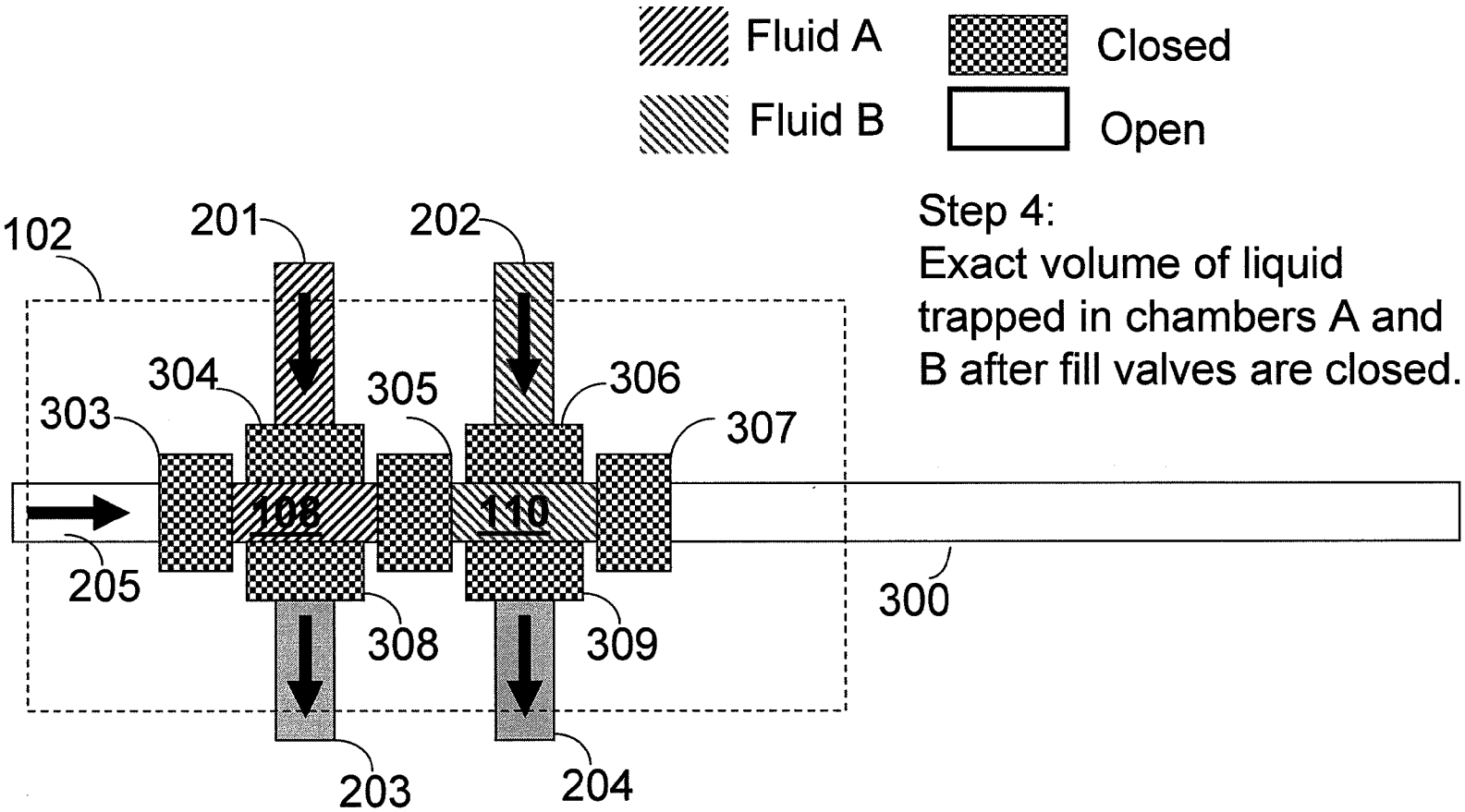

FIG. 3F shows an example of a subsequent step during operation of the droplet generator 102. Valves 304 and 306 are closed to trap reagents A and B in the respective fluid chambers 108 and 110. A precise volume of each reagent is thus measured and trapped, and no tuning of parameters is required to achieve the exact droplet size and mixing proportions that are desired.

Figure 3G:
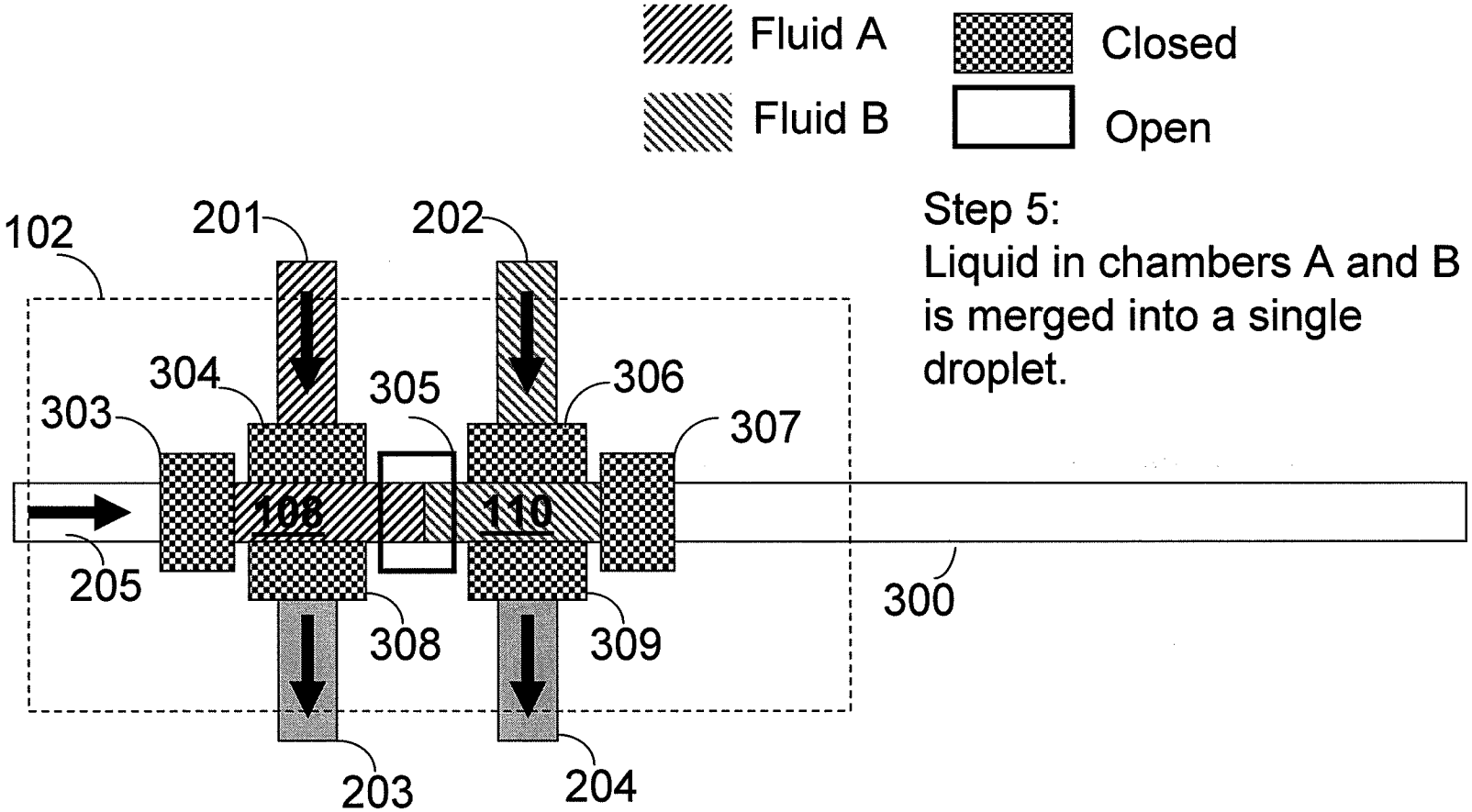

FIG. 3G shows an example of a subsequent step during operation of the droplet generator 102. Valve 305 between fluid chambers 108 and 110 is opened, so that the first fluid chamber 108 holding reagent A and the second fluid chamber 110 holding reagent B become one single combined chamber and the contents of reagents A and B merge together, forming a single droplet that has reagent A at one end and reagent B at the other.

Figure 3H:
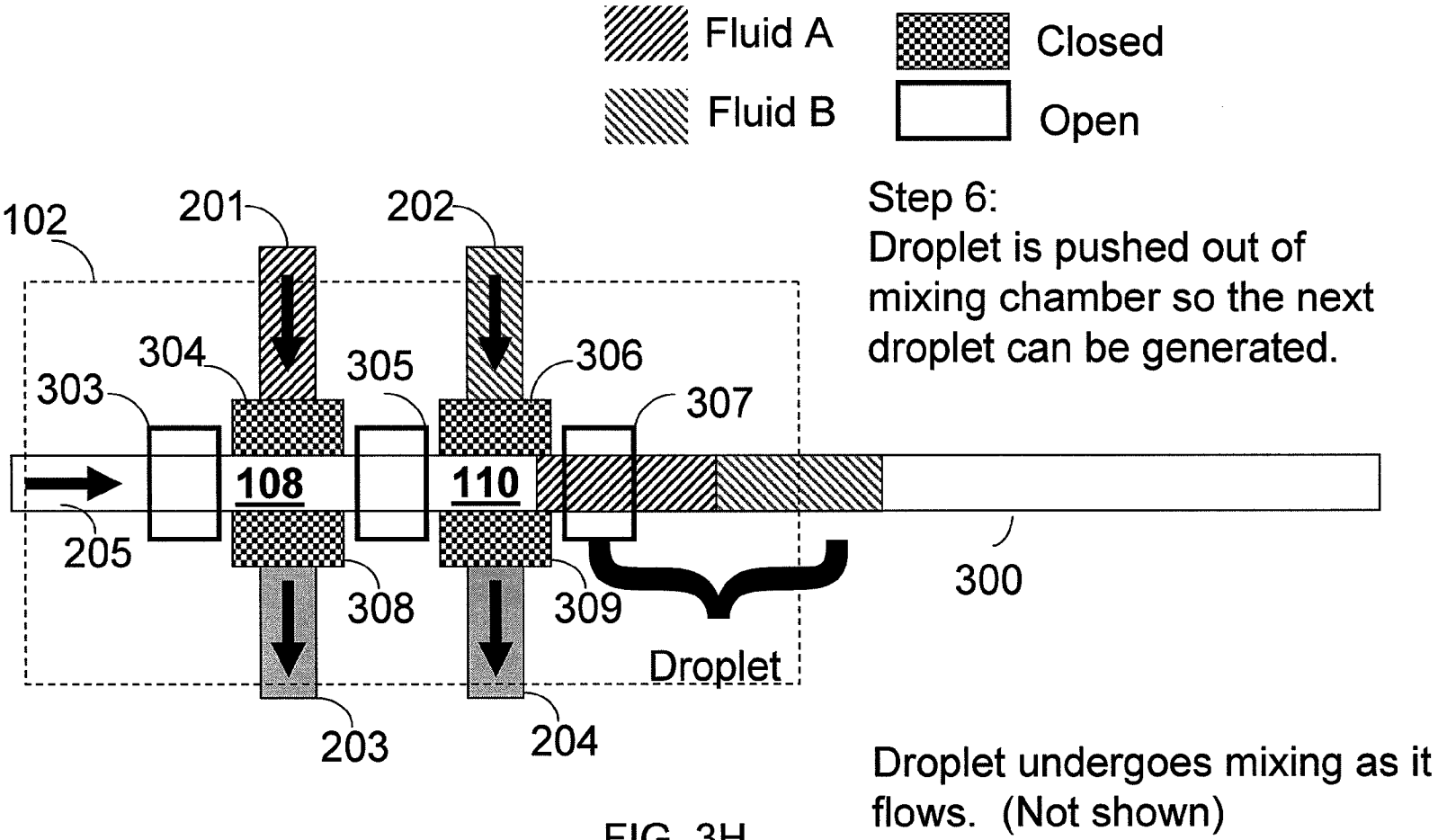

FIG. 3H shows an example of a subsequent step during operation of the droplet generator 102. Valves 303 and 307 are opened, and gas (e.g., air, nitrogen/argon if reactions are sensitive to air or moisture, etc.) is admitted from gas inlet 205 to push the formed droplet out of the filling region along microchannel 300.

In the above example of dead-end filling at the inlets, gas is used. It is noted that an immiscible fluid, such as a liquid that can later be removed, may be used for the same purpose. The immiscible fluid may be later removed, e.g. by a selectively permeable membrane.

Figure 3I:
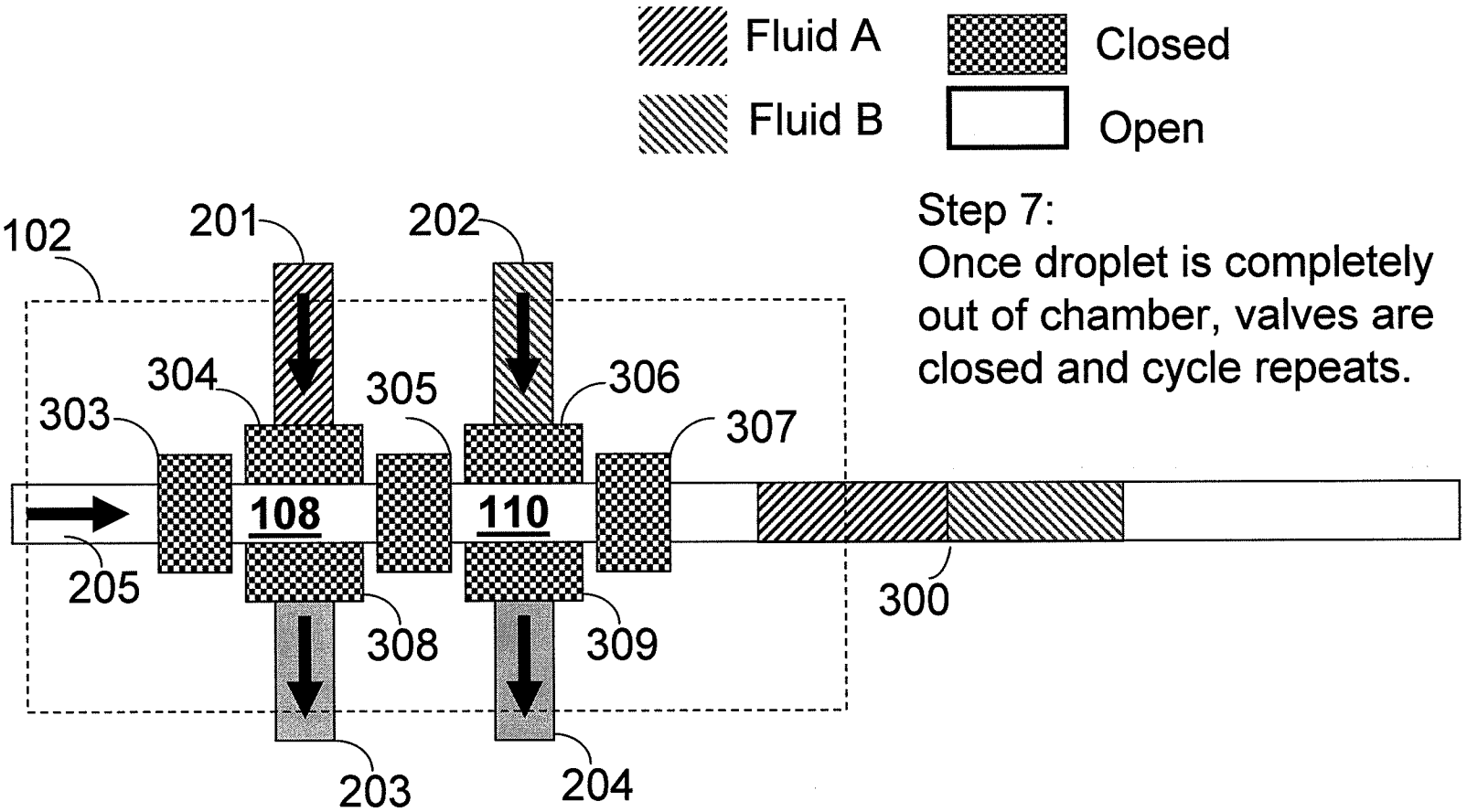

FIG. 3I shows an example of a subsequent step during operation of the droplet generator. Once the formed droplet is pushed outside the fluid chambers 108 and 110, the valves 303, 305, and 307 are closed and the droplet generation cycle may repeat. Meanwhile, the gas pressure trapped between the formed droplet and valve 307 of the droplet generator may continue to push the formed droplet further into the mixing channel.

It is noted that the valves 304 and 306 perform a "latching" mechanism whereby the reagents can be "synchronized," in a manner similar to electric charges in a digital integrated circuit (IC). Latching may ensure even the first droplet has the correct composition of liquids. It is noted that, for the same objective, latching may also be used in conjunction with a mechanism of automatic purging of reagent lines (see, for example, U.S. Patent Application No.: 2008/0131327, "System and method for interfacing with a microfluidic chip").

A further advantage of having valves on the micromixer chip 200 can be the ability to stop the droplet flow so it can be analyzed with (inexpensive) low-speed, low-sensitivity cameras etc. according to some embodiments of the current invention. Continuous flow approaches require high-speed photography or averaging techniques to analyze droplet based mixing in a quantitative fashion. The valves also allow very simple integration to other microfluidic chip components, or to external fluid handling systems for automation.

Some embodiments of the current invention can provide an improved way to perform mixing when at least one participating reagent involves a tiny volume (e.g., 10 nL) or the reagents being mixed have disparate properties such as viscosity, surface tension, hydrophobicity/hydrophilicity, etc.

Droplet generation in existing continuous flow devices is difficult and is achieved by carefully tuned flow rates of (or pressures driving) the inlet fluids and carrier/separator stream, as well as properties of these fluids. Many parameters are inter-related, and it is impossible to change one parameter without affecting many others. As a result, it is difficult to independently control the desired droplet sizes and mixing ratios within the droplet without substantial additional experimentation and characterization of the system (e.g., laborious modeling). In addition, when using different total volumes of the two starting liquids, there can be different total fluidic resistances from the liquid inlet to the mixing microchannel, further complicating the establishment and maintenance of a stable droplet flow. It is noted that different volumes can occur in automated systems, e.g., when mixing a number of different precious samples with a bulk reagent/solvent of larger volume.

In practical systems, droplet generation is further complicated when using liquids of different viscosities, surface tension, hydrophobicity/hydrophilicity or other physical parameters. All of these factors can have a significant impact on ultimate droplet size and the ratio of reagent A to reagent B for each droplet in actuality. Although it is possible to tune the droplet generator for one set of parameters, it can be difficult to switch from one reagent to another without changing many parameters. Thus, when changing reagent, the droplet generator may no longer be appropriately tuned.

Furthermore, in existing devices, a significant number of droplets may need to be "discarded" before a stable droplet flow is established. That is, it is very hard to start effective mixing at the very first droplet. This can waste considerable amount of valuable reagents, and it may be difficult in an automated system to determine both when the steady state has been achieved, and which droplets to discard. Reagent waste also occurs in all of the known "injection" schemes developed so far in elastomeric valve-containing microfluidic chips.

In contrast, by "latching" the fluid flow during filling of the mixing reservoirs, the need for a parameter tuning phase at startup can be eliminated and accurate mixing can begin with the first droplet. Consequently, a droplet can be accurately and efficiently generated in a predictable manner. By loading both liquids right up to the inlet and holding them with valves, we can ensure that even the very first droplet can be accurately mixed at the correct ratio of liquids. Because we are filling a chamber of well-defined volume, we can get a precise 1:1 (or any desired) ratio for every single droplet. The filling is achieved with valves that act independently of fluid properties such as viscosity, solvent composition, surface-tension, etc. We may also mix two gases between liquid plugs (like oil or water plugs if two gases are not water-miscible). Thus it is easy to switch to different fluids.

Furthermore, inlet liquids can be driven by pressure in an automated system, a much cheaper and more flexible approach than volume flow-rate-controlled flow. Additionally, droplets can be generated in an end-to-end fashion and can be mixed in a straight channel. No wavy channel is needed and thus fabrication is simpler in some embodiments of the current invention.

It should be noted that the volume of droplets and mixing ratio of reagents may be controlled at the level of the chip design, by fabricating fluid chambers with the desired volumes and proportions. Variable mixing ratio can also be achieved by partitioning one or both chambers with extra valves so that various portions of the chamber(s) can be selectively opened when generating a particular droplet. For example, we can design a chip wherein one unit portion of reagent A may be mixed with 1, 2, 3, 4, 5, or even more unit portions of reagent B. The chip design can be further generalized to accommodate a programmable variation of two orders of magnitude in a chip of practical size. This feature may be very useful, for example, for automated generation of series dilutions for optimizing reaction conditions and parameters.

FIGS. 4A-4I illustrate an example of generating droplets with variable mixing ratios according to an embodiment of the current invention.

Figure 4A:
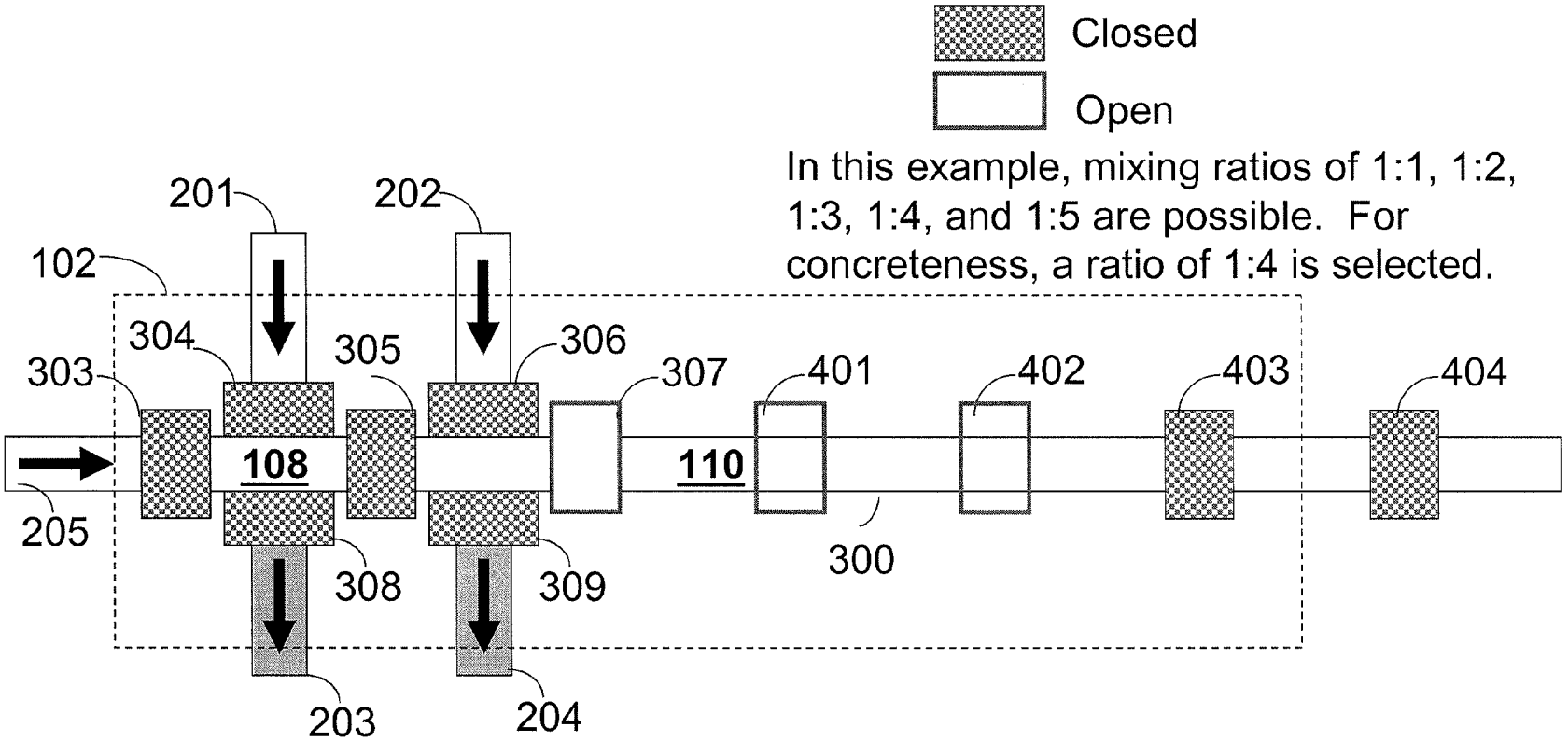
FIGS. 4A-4I illustrate an example of generating droplets of variable mixing ratios according to an embodiment of the current invention.

FIG. 4A shows a schematic view of a droplet generator that could correspond to droplet generator 102 that is capable of variable mixing ratios according to an embodiment of the current invention. The droplet generator 102 has two fluid chambers located along microchannel 300. The first fluid chamber 108 is surrounded by valves 303, 304, 305, and 308. Inlet 201 is a port through which a reagent may be loaded into the first chamber 108. Gas inlet 205 is a port through which gas may be allowed to enter microchannel 300. Vacuum port 203 is a port that may connect to a vacuum pump. The second fluid chamber 110 may be surrounded by valves 305, 306, 403, and 309. The second fluid chamber 110 can further utilize valves 307, 401, 402, and 404. Valve 305 may connect the first fluid chamber 108 with the second fluid chamber 110. Inlet 202 is a port through which a reagent may be loaded into the second fluid chamber 110. Vacuum port 204 is a port that may connect to a vacuum pump. In this configuration, mixing ratios of 1:1, 1:2, 1:3, 1:4, and 1:5 can be realized and a ratio of 1:4 is illustrated as an example in which valves 307, 401, and 402 are open.

Figure 4B:
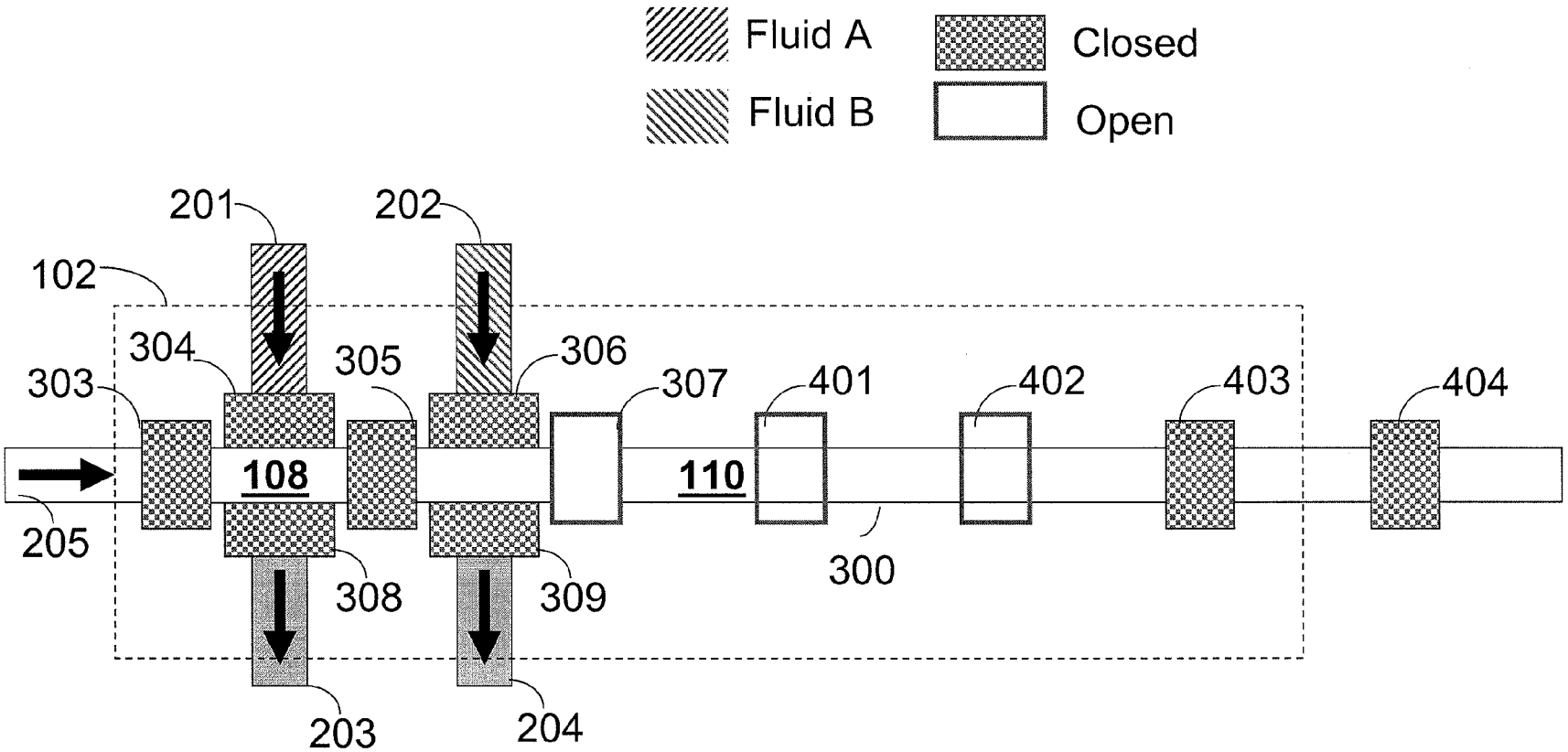

FIG. 4B shows an example of one step during operation of the droplet generator 102. Inlet 201 is prefilled with reagent A and inlet 202 is prefilled with reagent B. To start the mixer, it is noted that the input reagents must be connected to micromixer chip 200. Further, it is noted that the principle of end-filling may be used to ensure the reagents displace substantially all air in inlets 201 and 202 such that reagent A and reagent B are touching one side of valve 304 and 306, respectively.

Figure 4C:
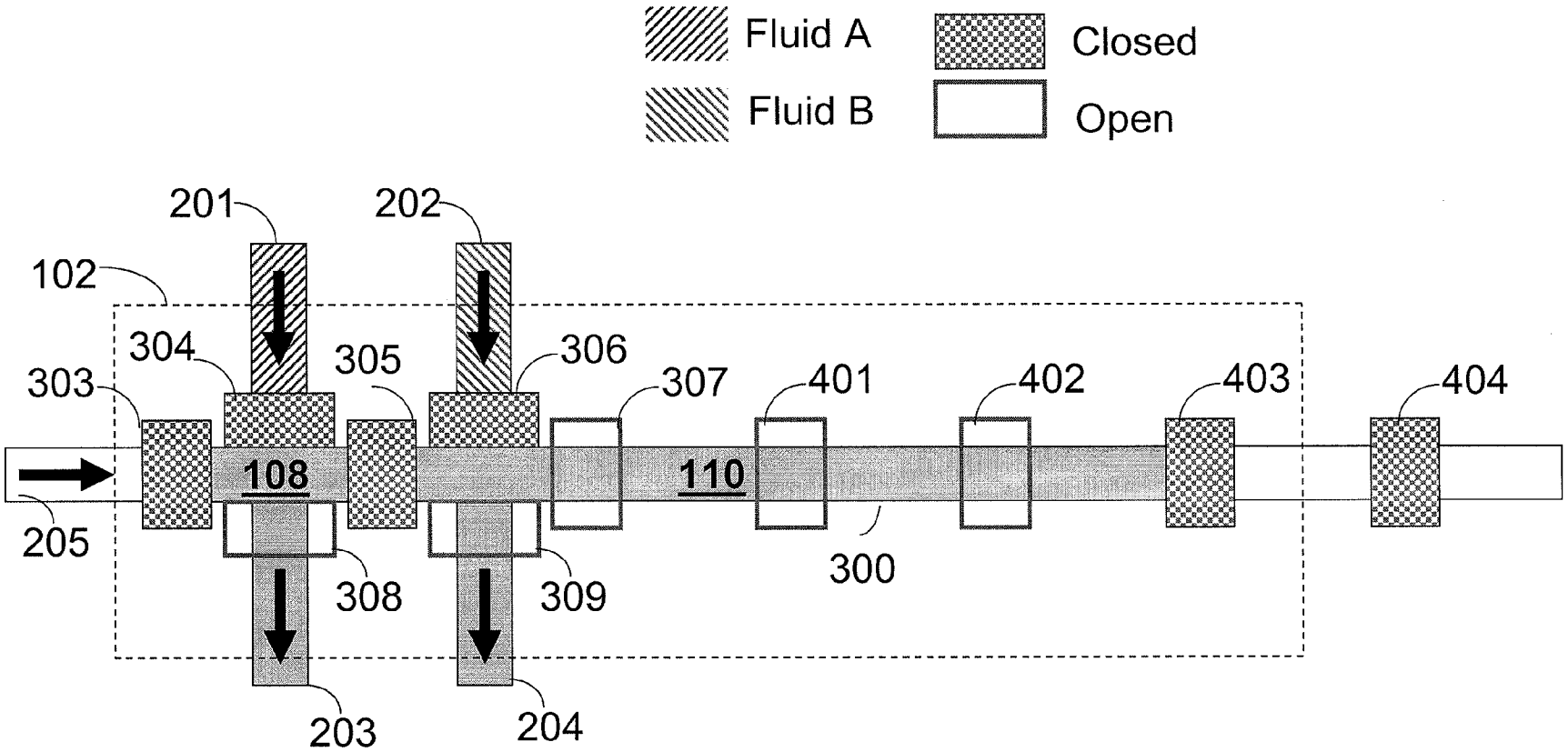

FIG. 4C shows an example of a subsequent step during operation of the droplet generator 102. Valves 308 and 309 may be opened and vacuum may be applied to the droplet generator 102 to remove substantially all air in the fluid chambers 108 and 110.

Figure 4D:
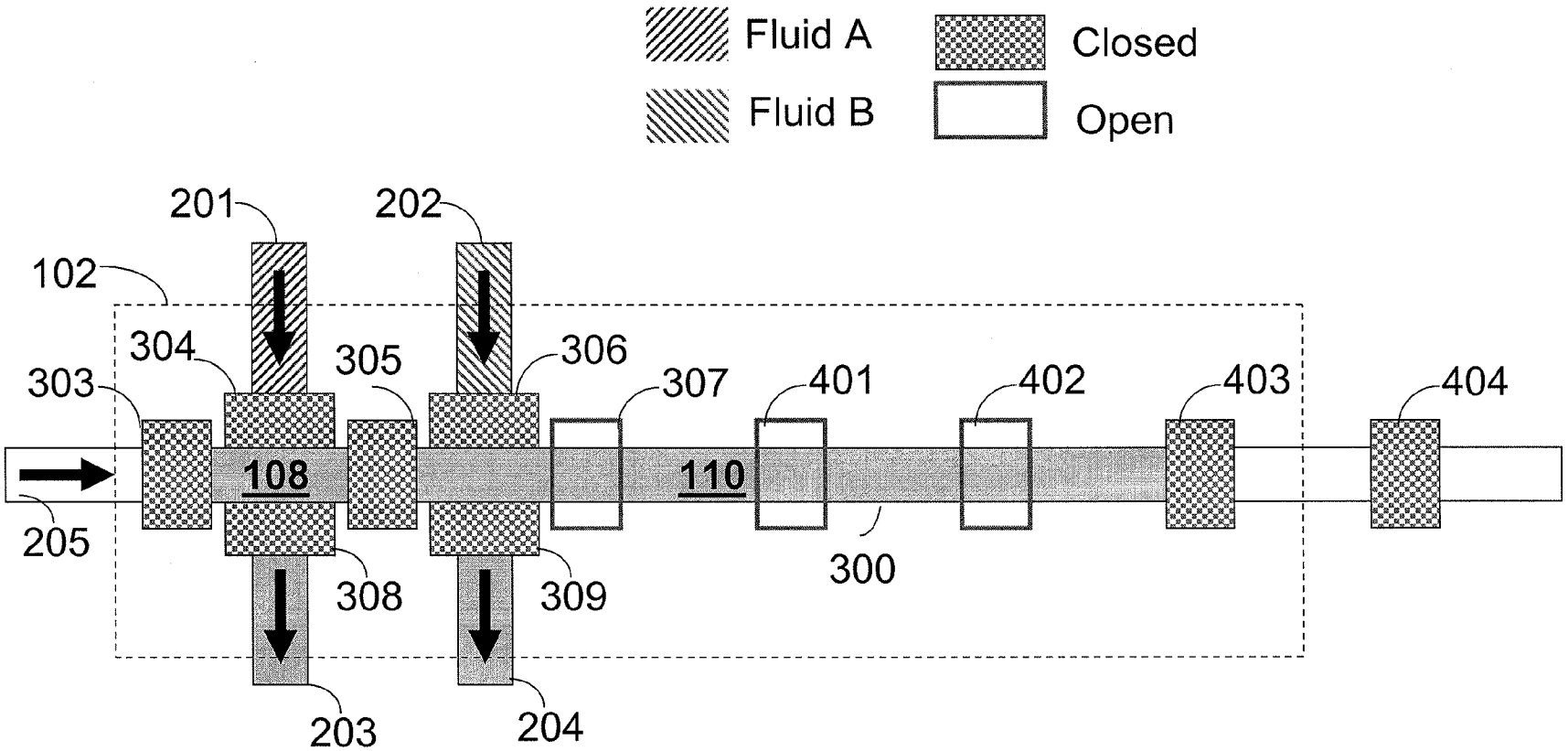

FIG. 4D shows an example of a subsequent step during operation of the droplet generator 102. Valves 308 and 309 may be closed to maintain the vacuum inside the fluid chambers.

Figure 4E:
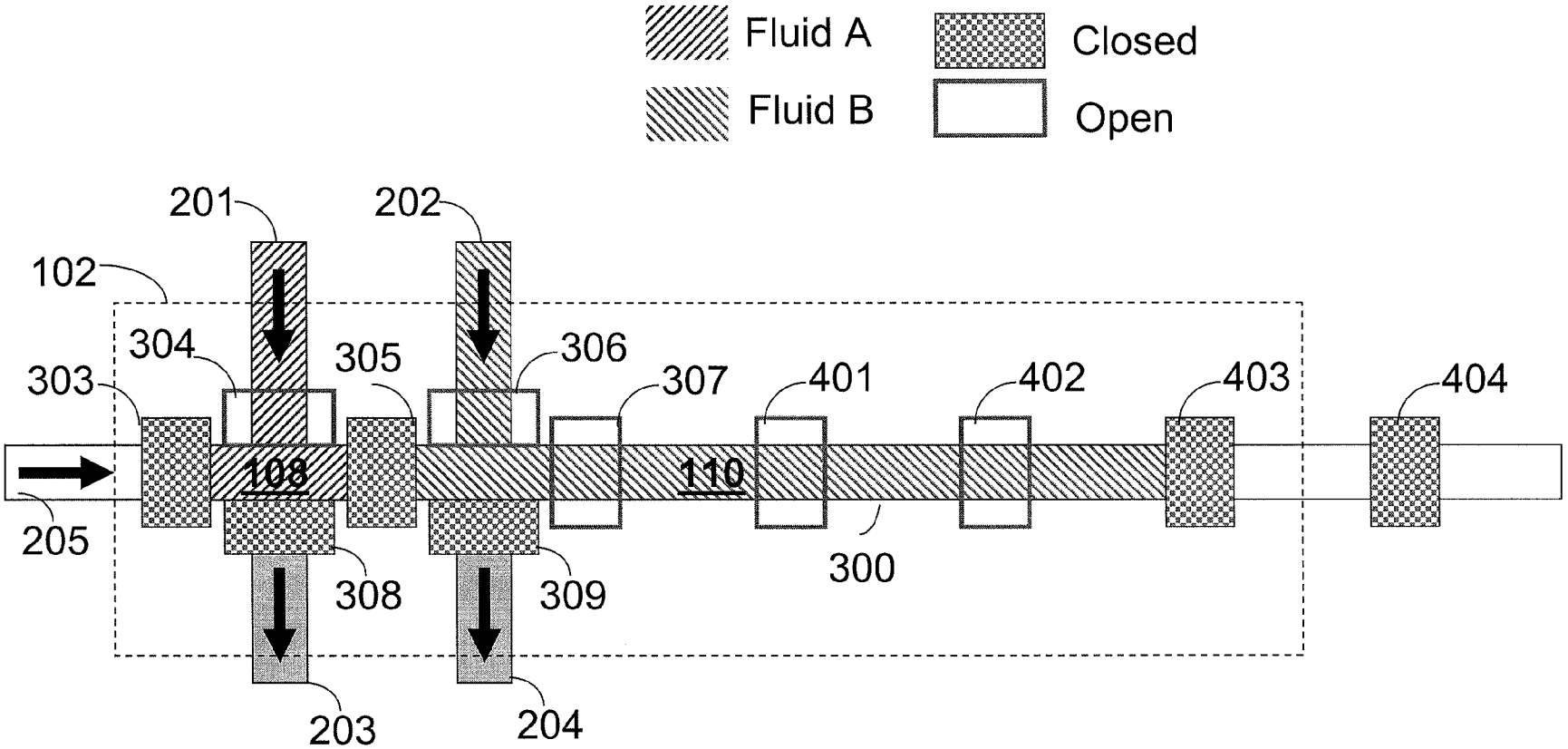

FIG. 4E shows an example of a subsequent step during operation of the droplet generator 102. Valves 304 and 306 are opened and reagents A and B rush in (assisted by the negative pressure provided by the vacuum step) to their respective fluid chambers 108 and 110 until full.

Figure 4F:
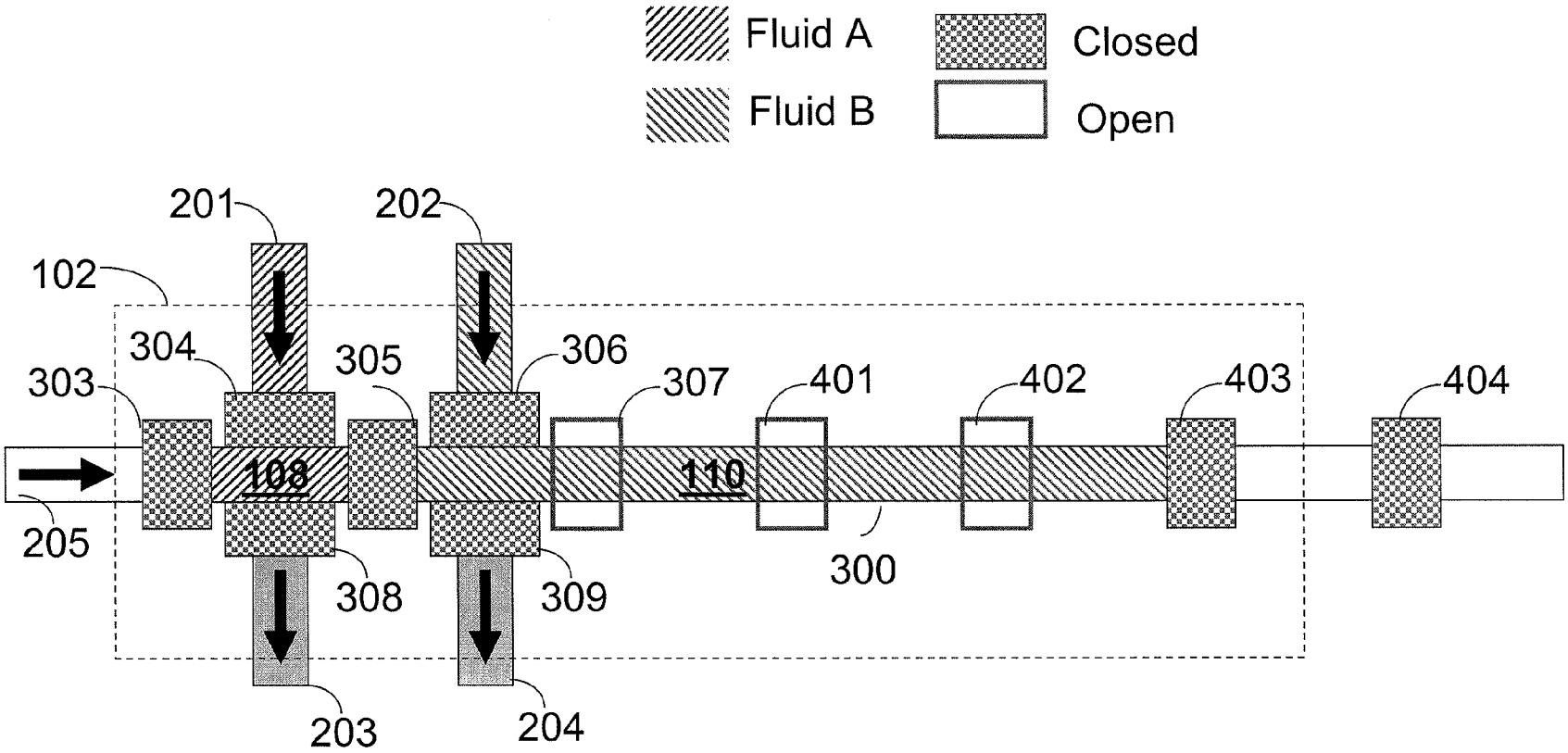

FIG. 4F shows an example of a subsequent step during operation of the droplet generator 102. Valves 304 and 306 are closed to trap reagents A and B in the respective fluid chambers. A precise volume of each reagent is thus measured and trapped, and no tuning of parameters is required to achieve the precise droplet size and mixing proportions that are desired.

Figure 4G:
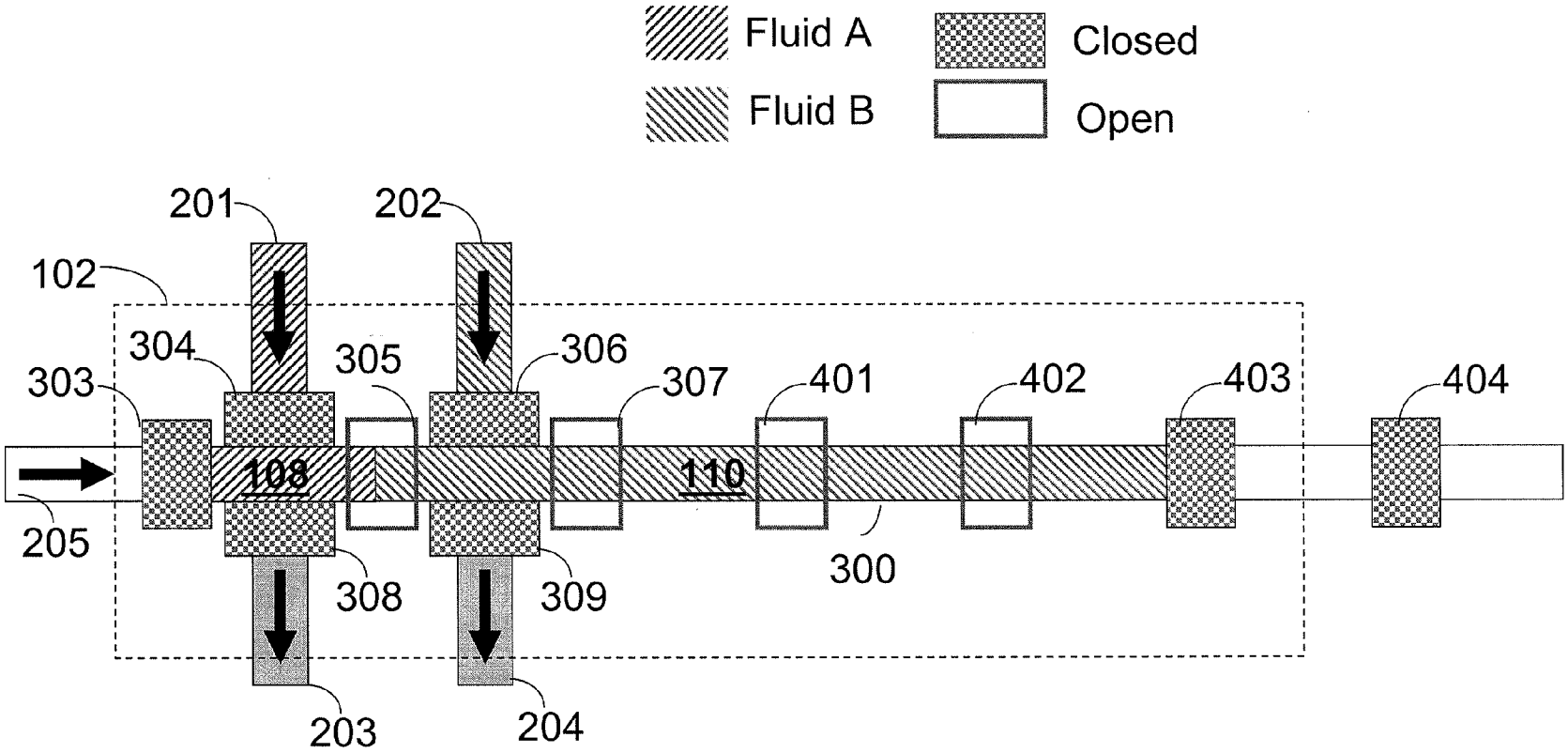

FIG. 4G shows an example of a subsequent step during operation of the droplet generator 102. Valve 305 between fluid chambers 108 and 110 is opened, so that the first fluid chamber 108 holding reagent A and the second fluid chamber 110 hold reagent B become one single combined chamber and the contents of reagents A and B merge together, forming a single droplet that has reagent A at one end and reagent B at the other, with a desired mixing ratio of 1:4.

Figure 4H:
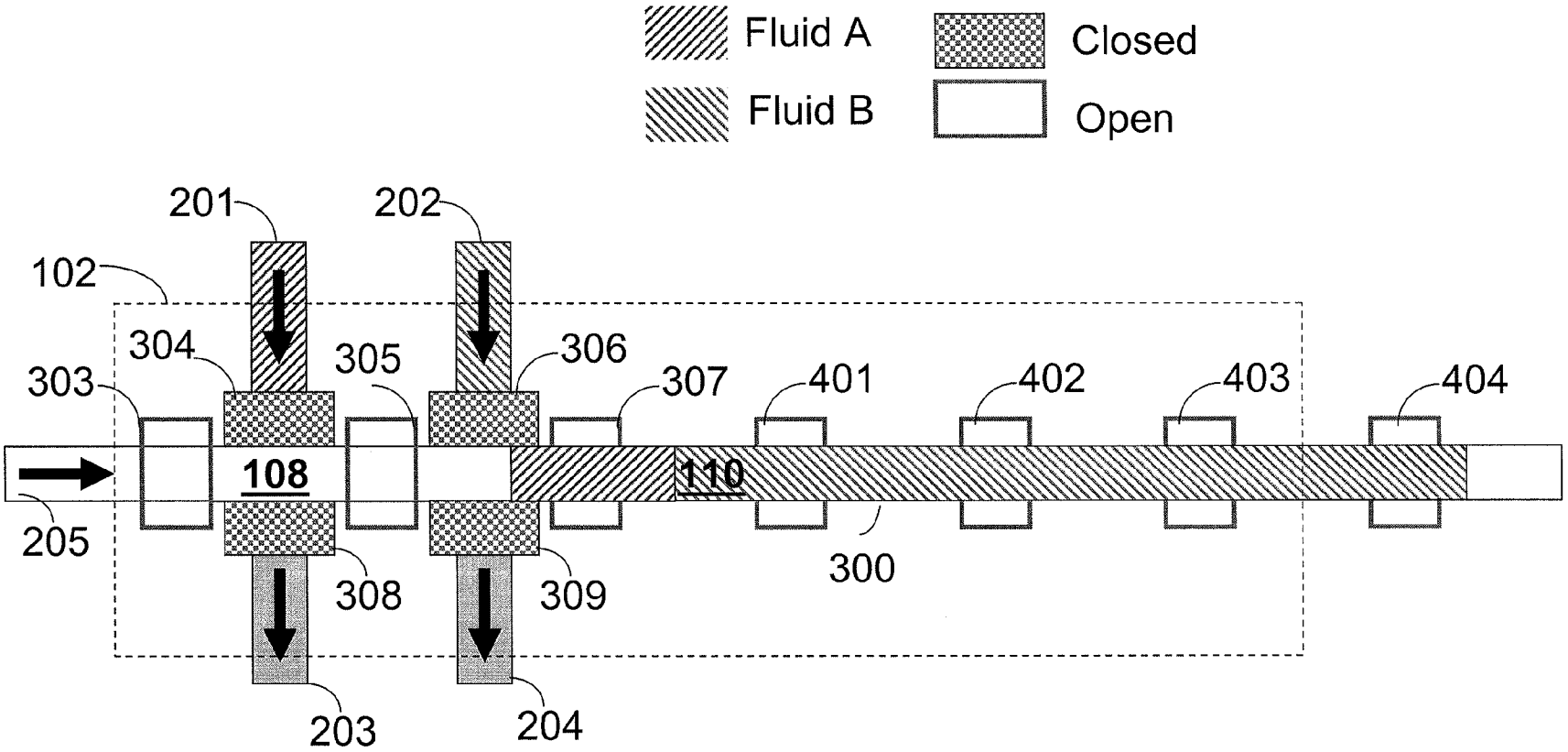

FIG. 4H shows an example of a subsequent step during operation of the droplet generator 102. Valves 303, 403, and 404 are opened, and gas (e.g., air, nitrogen/argon if reactions are sensitive to air or moisture, etc.) is admitted from gas inlet 205 to push the formed droplet out of the filling region along microchannel 300.

Figure 4I:
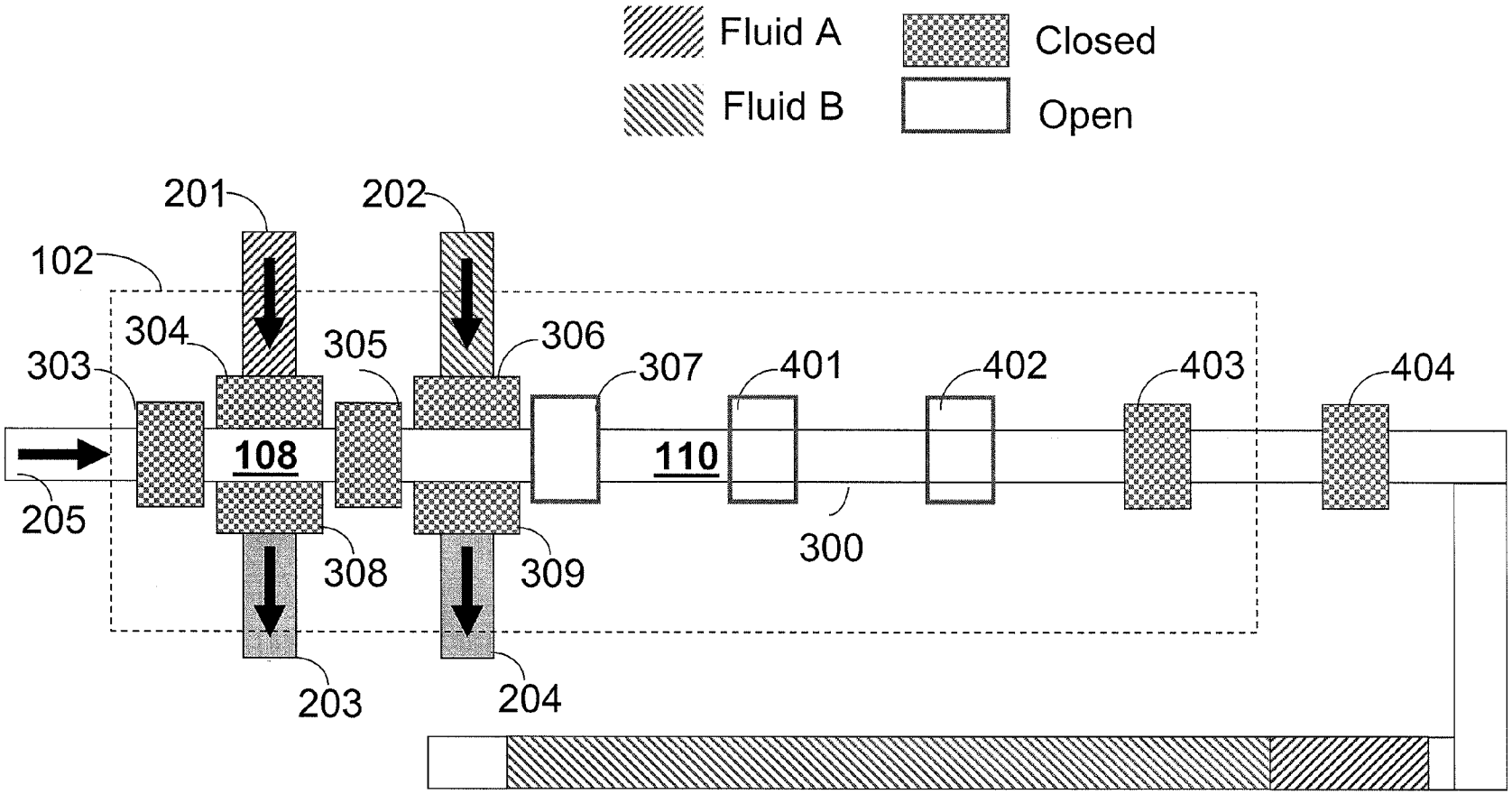

FIG. 4I shows an example of a subsequent step during operation of the droplet generator 102. Once the formed droplet is pushed outside the fluid chambers 108 and 110, the valves 303, 305, and 403 are closed and the droplet generation cycle may be repeated. Meanwhile, the gas pressure trapped between the formed droplet and valve 404 of the droplet generator 102 may continue to push the formed droplet further into the mixing channel.

Unlike precisely tuned droplet generators that can mix volumes of one pre-determined ratio or alternate between two or more different mixing ratios, some embodiments of the current invention enables flexible and broad control over the mixing ratio and may even allow changing the mixing ratio on the fly from one droplet to the next. Changing the mixing ratio on the fly is very useful for automation of reaction condition optimization and other high-throughput screening applications. Changing the mixing ratio can be done reliably and predictably, even on the very first attempt, and does not require a special tuning procedure to arrive at a steady state sequence of droplets having the desired mixing ratio.

Mixing of three or more reagents may also be realized in a straightforward manner according to some embodiments of the current invention. We can simply add a third fluid chamber in series with the two in the above examples. If desired, this could be generalized to a large number of reagents. Some inlets could be used for cleaning solutions; for example, the mixing chamber could be cleaned between each droplet, or a set of droplets. The straightforwardness and predictability of mixing multiple solutions is in stark contrast to continuous flow droplet generators. For example, Srisa-Art et al. (Srisa-Art, M., deMello, A. J., Edel, J. B., High-throughput DNA droplet assay using picoliter reactor volumes, Anal. Chem. 79: 6682-6689, 2007) mixed three solutions to produce droplets with varying fluorophore concentration. However, in this reference, to achieve various concentrations, simultaneous tuning of several volume flow rates was required.

Other capabilities associated with continuous flow droplet generators may also be realized with some embodiments of the current invention. For example, generation of droplets of alternating composition could be achieved at the programmatic level, i.e. by filling one chamber, pushing it out of droplet generator, filling a different chamber, pushing it out, and alternating back and forth.

One way of adjusting the mixing ratio is to adjust the reagent driving pressure under fixed filling time, or using variable filling time, such that fluid chambers 108 and 110 are filled to essentially the desired extents. This approach may make the droplet generator a little more dependent on fluid properties, but can give a finer degree of control over ratio.

Because the droplets are generated in an end-to-end fashion, a straight channel is sufficient to give effective mixing over a very short distance according to some embodiments of the current invention. Thus, the mixing channel may simply include a straight channel in some embodiments of the current invention. Bends in the path can be added to provide some mixing across the long axis of the droplet to account for any asymmetries in the initial droplet generation in other embodiments of the current invention. In other embodiments, grooves or other structures can be included in the mixing channel to induce chaotic advection in the flow.

Depending on the microfluidic technology and application, bubbles are often undesirable in microfluidic systems. A gas extractor, e.g., a degasser 210, may be needed to remove the gas bubbles that exist in the liquid stream, and to reconstitute the series of bubbles as a continuous plug of fluid. The degasser 210 can also remove gas-containing bubbles that are generated by a reaction after mixing. The degasser 210 may further remove gas pockets between a sequence of droplets.

The degasser 210 may ensure that no gas enters the next step/process of a microfluidic chip, e.g. a chemical reactor. The degasser 210 may have a long pathway for droplets to flow, with an adjacent (e.g., in a lower layer of the chip, separated by a thin, e.g., 20 μm, layer of polymer) channel to which vacuum is applied.

Figure 5:
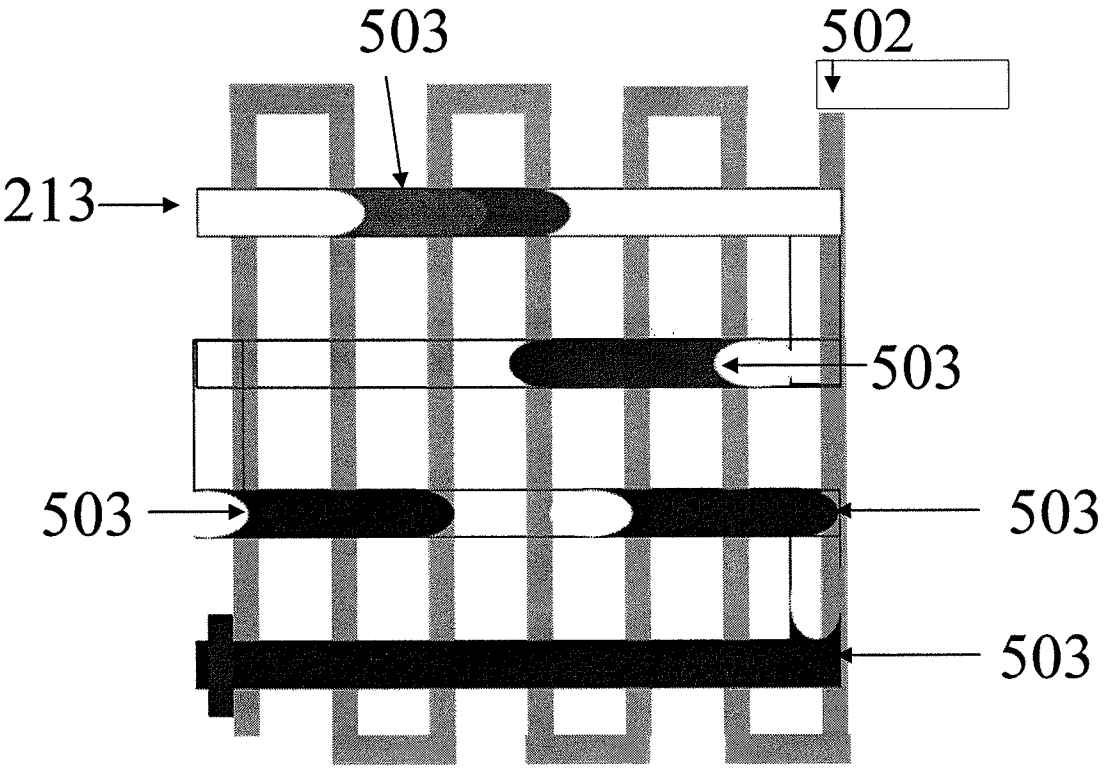
FIG. 5 shows a schematic illustration of a degasser according to an embodiment of the current invention.

FIG. 5 shows a schematic illustration of a degasser 210 according to an embodiment of the current invention. Droplets 503 flow in a horizontal serpentine channel 213 (serpentine to pack a long length into small chip area). Vacuum is applied from vacuum channel 502 below, orientated perpendicularly. At each crossing of serpentine channel 213 and vacuum channel 502, air is pumped out of the serpentine channel 213 due to the pressure drop across the thin gas-permeable membrane separating a droplet 503 and vacuum channel 502, and the spacing between droplets 503 decreases. By judicious choices of the pressure of injected air, time duration of air injection, and length of serpentine channel 213, substantially complete removal of air is possible. It is noted that if the vacuum channel 502 is directly below the serpentine channel 213 and is allowed to follow along the same path, it would simply collapse and thus become ineffective. The perpendicular orientation reduces the surface area of the permeable membrane through which the applied vacuum is acting, but provides structural integrity of the channel.

We describe, as one example, the use of air to separate droplets to facilitate mixing. In other embodiments, an immiscible fluid can be used such as a liquid that can later be removed, e.g. by a selectively permeable membrane. Therefore, all such variations are intended to be within the scope of the current invention.

The droplet generator component and overall system according to an embodiment of the current invention may provide a way to programmatically mix reagents in different mixing ratios, which is useful in several applications such as, for example, generating a dilution series to optimize reaction conditions for labeling of biological molecules or organic compounds with radioisotopes or fluorophores, etc. The mixing ratio can even be changed on the fly, i.e., from one droplet to the next, if desired. Such flexibility is not afforded by existing approaches in which the mixing ratio is built into the chip design and the various variables (e.g., flow rate, reaction time, etc.) that impact the mixing process are interdependent and cannot be independently set.

Some aspects of the invention can facilitate the integration of two different types of microfluidic devices, i.e. digital integrated microfluidic devices, and droplet-based continuous flow systems. The droplet generator 102 and degasser 210 can be used in bridging these types of systems. One application taking advantage of the hybrid approach is chemical synthesis in small batches, such as to produce radiolabeled probes for positron emission tomography (PET) imaging. Batch-mode synthesis requires integrated microfluidic valves to manipulate the small volumes of liquid and keep the liquid trapped during reaction steps that are heated. The digital integrated microfluidic platform currently offers only a rotary mixer as an integrated mixing solution for small volumes of liquid; unfortunately this rotary mixer can be rather slow in certain volume regimes e.g., hundreds of nL to several μL or more) and thus is not suitable for processes involving short-lived radioisotopes because substantial radioactive decay can occur during the prolonged mixing steps. Some embodiments of the current invention make it possible to integrate fast droplet-based mixers with what is traditionally considered the continuous-flow device domain.

This mixing chip according to an embodiment of the current invention can be used as a component of a microfluidic chip, or can be integrated with an external microfluidic system when a desired process must be carried out with small volumes and/or very rapid mixing. For example, by building an interface between a semi-automated chemical synthesis unit and the mixing chip, one may obtain a system wherein the synthesis unit prepares a radiolabeled molecule while the mixing chip automatically mixes a tiny volume of this radiolabeled molecule (a radiolabeling tag or prosthetic group) with a biological molecule to facilitate a biological labeling reaction.

We believe the micromixer design according to an embodiment of the current invention is extremely flexible, and it is a natural fit to "digital" integrated microfluidic devices (i.e., chips that use valves to control the flow of fluids). It can solve many problems of current mixer setups and help to ensure that droplet mixing is accurate on even the first drop because there is no tuning procedure, and the filling may not have to rely on the contents of the downstream channel and back-pressure that this channel generates. There is essentially no waste of material in filling, e.g., a flow-through injector element. Furthermore, many droplet parameters (e.g., size, composition, etc.) may be tuned separately, without having to consider the links between flow rates, concentrations, speed, droplet size, etc. that plague existing approaches. The mixer design therefore enables a wide variety (different solvent, viscosity, surface tension, hydrophilicity/hydrophobicity, etc) of fluids to be mixed at different mixing ratio, and even allows mixing of three or more individual solutions. For these reasons, our mixer design according to an embodiment of the current invention is particularly suited for automated microfluidic applications.

The micromixer according to an embodiment of the current invention is suitable for integration into other application-specific chips and may have applications in, but not limited to: fluorophore labeling of precious primary antibodies; radiolabeling of nanoparticles, small molecules, biomolecules for micro-PET/PET imaging; radiolabeling for in vivo biodistribution studies or in vitro cell assays; fast chemical reactions; fast biological reactions (for example, enzymatic reactions); organic synthesis (conventional); synthesis of mono dispersion of nanoparticles; drug screening; performing conventional enzyme-linked immunosorbent assay (ELISA) in a continuous-flow fashion; mixing different portions of reagents (controlled concentration); screening reaction condition and reagent equivalent; droplet single cell analysis of DNA hybridization using SYBRT™-green; and automatic matrix assisted laser desorption/ionization mass spectrometer (MALDI-MS) spotting.

For example, making fluorescence-labeled antibodies to directly visualize antigens for applications such as, e.g. ELISA, cell immunostaining, and fluorescent-activated cell sorting (FACS), etc., can be a time-consuming, tedious, and expensive process. For labeling experiments, the optimal ratio between labeling motif and biological molecule often has to be determined by trial and error. During such processes, a considerable amount of precious biomaterial is inevitably wasted. An integrated micromixer system according to an embodiment of the current invention can provide a simple automated method to generate the required data for optimizing the ratio of fluorophore-antibody labeling using only a minute amount of sample.

In using $^{18}$F-labeled prosthetic groups, such as N-succinimidyl-4-[$^{18}$F]fluor benzoate ([$^{18}$F]SFB), to label nanoparticles, small molecules, and biomolecules for micro-PET/PET imaging, there is a need to perform such a routine process automatically just prior to imaging to reduce operator exposure to radiation, improve repeatability, and avoid radioactive decay of precious, short-lived labeled probes, etc. Examples of small molecules and bio-molecules may include, but are not limited: intact monoclonal antibodies (such as, Herceptin, Cetuximab, Bevacizumab, etc.) and their engineered fragments, small high-affinity protein scaffolds (such as, affibodies), small interfering ribonucleic acids (siRNAs), deoxyribonucleic acids (DNAs), peptide nucleic acids (PNAs), locked nucleic acids (LNAs) and their derivatives, mono-/oligo-saccharides and glycoproteins, and various peptides and analogs, etc. An integrated micromixer/radiochemistry microfluidic chip could achieve this. In the case of preparation of [$^{18}$F]SFB probes, the micromixer may perform the entire reaction if the whole chip is heated to the modest temperatures required.

Some embodiments of the current invention may be applied in $^{64}$Cu-DOTA (1,4,7,10-tetraazacyclododecane-1,4,7,10-tetraacetic acid) and $^{124}$I-labeling of nanoparticles, small molecules, and biological molecules for micro-PET imaging, receptor binding studies, biodistribution studies, metabolism studies, or cell assays. Examples of molecules may include, but are not limited to: intact monoclonal antibodies (such as, Herceptin, Cetuximab, Bevacizumab, etc.)

and their engineered fragments, small high-affinity protein scaffolds (such as, affibodies), small interfering ribonucleic acids (siRNAs), deoxyribonucleic acids (DNAs), peptide nucleic acids (PNAs), locked nucleic acids (LNAs) and their derivatives, mono-/oligo-saccharides and glycoproteins, and various peptides and analogs, etc.

Some embodiments of the current invention may be used in conventional organic synthesis processes by efficient mixing of reacting reagents with subsequent reactions somewhere on or off chip.

Further, in synthesizing mono-dispersed nanoparticles (e.g., Au, Ag, $SiO_2$, $CdCl_2$, CdS, CdSe, etc.), some embodiments of the current invention may be applied to achieve mixing of precise volumes of inorganic precursors.

Some embodiments of the current invention may be applied in fast chemical reaction. For example, each droplet actually is a snap shot of an instant during a reaction process in both space and time. By looking at droplets at different distances along the flow, a reaction process can be monitored and studied in detail. One example application, not intended to limit the scope of the embodiment, is the study of biocatalytic reactions involving multiple enzymes.

Some embodiments of the current invention may be applied in drug screening experiments using cells in-vitro, for example, in mixing different portions or combinations of drugs. In addition to drugs, the effects additional molecules such as growth factors, ligands, or antibodies and their engineered fragments, short peptides and analogs, etc., and their combinations, may be studied.

In another example of droplet-based cell analysis of deoxyribonucleic acid (DNA) hybridization using SYBRT™-green, some embodiments of the current invention may be used in virus detection and messenger ribonucleic acid (mRNA) expression analysis. Virus detection may involve applying direct lysis of sample, denaturing and cleaning out double strands of DNA, applying primer pairs, and performing polymerase chain reaction (PCR) or real-time polymerase chain reaction (RT-PCR), applying fluorescent dye (sensitive for double strand only), and performing fluorescence readout. mRNA expression analysis may take the steps of applying direct lysis of sample; denaturing and cleaning out double strands of DNA; applying primer pairs; performing RT-PCR; applying fluorescence dye (for double strand only); and performing fluorescence read-out.

In automatic matrix assisted laser desorption/ionization mass spectrometer (MALDI-MS) spotter, the droplet mixer according to an embodiment of the current invention can mix samples with matrix solution very effectively before spotting on the MALDI-MS sample loading plate. It may be desirable that the chip be disposable to avoid sample contamination.

To increase the rate of droplet generation and the total throughput, one technique is to use several droplet generators in parallel with the outlets combined into a single channel on one single microfluidic chip. For each cycle, all N droplet generators inject a droplet in rapid succession into the common channel.

In describing embodiments of the invention, specific terminology is employed for the sake of clarity. However, the invention is not intended to be limited to the specific terminology so selected. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

We claim:

1. A microfluidic mixer, comprising:

a droplet generator comprising a main channel; and a droplet mixer in selective fluid connection with said droplet generator, wherein a portion of said main channel is structured to be reconfigured into first and second fluid chambers with one of a first and second valve at each opposing end of said first and second fluid chambers and a third valve separating said first and second fluid chambers, wherein said first fluid chamber has a first fluid input channel that is separable from said first fluid chamber by a first fluid input valve situated at the periphery of said first fluid chamber, wherein said second fluid chamber has a second fluid input channel that is separable from said second fluid chamber by a second fluid input valve situated at the periphery of said second fluid chamber, wherein said first and second fluid chambers are structured to be at least partially filled with respective first and second fluids that can each be held in isolation for a selectable period of time, wherein said first and second fluid chambers are further structured to be reconfigured into a single combined chamber to allow said first and second fluids in said first and second fluid chambers to come into fluid contact with each other in said combined chamber for a selectable period of time prior to being brought into said droplet mixer, and wherein said main channel is configured to contain said first and second fluids that have come into fluid contact with each other outside said first and second fluid chambers upon opening of said first and second valves.

2. The microfluidic mixer according to claim 1, wherein at least one of said first fluid chamber and said second fluid chamber has a volume that is selectable from a plurality of volumes.

3. The microfluidic mixer according to claim 2, wherein said droplet generator comprises a plurality of valves that can be selectively opened and closed to provide said volume of said at least one of said first and second fluid chambers that is selectable from a plurality of volumes.

4. The microfluidic mixer according to claim 1, wherein said first fluid input channel is structured to allow delivery of said first fluid to said first fluid chamber and said second fluid input channel is structured to allow delivery of said second fluid to said second fluid chamber.

5. The microfluidic mixer according to claim 4, wherein said first and second fluid input channels are structured to allow delivery of first and second fluids that are different from each other.

6. The microfluidic mixer according to claim 1, wherein said droplet mixer comprises a microchannel in fluid connection with said main channel of said droplet generator to receive droplets from said droplet generator while in operation.

7. The microfluidic mixer according to claim 6, wherein said microchannel has a serpentine shaped path.

8. The microfluidic mixer according to claim 1, further comprising a degasser in fluid connection with said droplet mixer, said degasser being structured to remove gas at least one of from or between droplets generated by said droplet generator.

9. The microfluidic mixer according to claim 8, wherein said degasser comprises a droplet channel and an evacuation channel, said droplet and evacuation channels having a region of close approach with a gas-permeable membrane therebetween such that when said evacuation channel is under at least a partial vacuum, gas can be exchanged from said droplet channel to said evacuation channel while in operation.

10. The microfluidic mixer according to claim 1, wherein a second portion of said main channel is structured to be reconfigured into a third fluid chamber with a fourth valve at one end and one of said first and second valves at an end opposing said fourth valve, wherein said third fluid chamber has a third fluid input channel that is separable from said third fluid chamber by a third fluid input valve situated at the periphery of said third fluid chamber, wherein said third fluid chamber is structured to be at least partially filled with a third fluid such that said first, second and third fluids can each be held in isolation for a selectable period of time, and wherein said first, second and third fluid chambers are further structured to be reconfigured into a single combined chamber to allow said first, second and third fluids in said first, second and third fluid chambers to come into fluid contact with each other in said combined chamber for a selectable period of time prior to being brought into said droplet mixer.

11. The microfluidic mixer according to claim 1, wherein said microfluidic mixer is adapted to be fluidly connected to at least one other microfluidic device.

12. The microfluidic mixer according to claim 1, wherein said first fluid chamber has a first evacuation channel that is separable from said first fluid chamber by a first evacuation valve situated at the periphery of said first fluid chamber, and wherein said second fluid chamber has a second evacuation channel that is separable from said second fluid chamber by a second evacuation valve situated at the periphery of said second fluid chamber.

* * * * *